US011845278B2

(12) United States Patent
Okui et al.

(10) Patent No.: US 11,845,278 B2
(45) Date of Patent: Dec. 19, 2023

(54) LIQUID EJECTING HEAD AND LIQUID EJECTING APPARATUS

(71) Applicant: Seiko Epson Corporation, Tokyo (JP)

(72) Inventors: Hiroaki Okui, Azumino (JP); Eiichiro Watanabe, Matsumoto (JP); Takahiro Kanegae, Shiojiri (JP); Kazuaki Uchida, Fujimi (JP)

(73) Assignee: SEIKO EPSON CORPORATION

( * ) Notice: Subject to any disclaimer, the term of this patent is extended or adjusted under 35 U.S.C. 154(b) by 38 days.

(21) Appl. No.: 17/588,605

(22) Filed: Jan. 31, 2022

(65) Prior Publication Data

US 2022/0242119 A1 Aug. 4, 2022

(30) Foreign Application Priority Data

Feb. 1, 2021 (JP) ..... 2021-014203
Nov. 12, 2021 (JP) ..... 2021-184673

(51) Int. Cl.
*B41J 2/14* (2006.01)

(52) U.S. Cl.
CPC ..... *B41J 2/14233* (2013.01)

(58) Field of Classification Search
CPC ..... B41J 2/14233; B41J 2002/14419; B41J 2002/14491; B41J 2202/08; B41J 2202/12
See application file for complete search history.

(56) References Cited

FOREIGN PATENT DOCUMENTS

| | | |
|---|---|---|
| JP | 2013-184412 A | 9/2013 |
| JP | 2017-007322 A | 1/2017 |
| JP | 2018-187846 A | 11/2018 |

OTHER PUBLICATIONS

Machine Translation of WO-2018101290 A1, Kyoso, Tadashi, "Inkjet Head and Inkjet Recording Device", Jun. 7, 2018, Entire Document (Year: 2018).*

* cited by examiner

*Primary Examiner* — Lisa Solomon
(74) *Attorney, Agent, or Firm* — Harness, Dickey & Pierce, P.L.C.

(57) ABSTRACT

A liquid ejecting head includes piezoelectric elements for ejecting liquid from nozzles, pressure chambers in communication with the nozzles, individual supply flow passages for supplying the liquid to the nozzles, individual collection flow passages for collecting the liquid not ejected from the nozzles, a diaphragm that defines a wall surface of the pressure chambers and deforms by driving the piezoelectric element, a flexible substrate having a drive circuit electrically coupled to the piezoelectric elements, and a heat release member that is either in contact with an surface of the flexible substrate that faces away from the drive circuit, or in contact with the drive circuit, and conducts heat of the drive circuit to the diaphragm. The heat release member is disposed closer to the individual supply flow passage than to the individual collection flow passage.

12 Claims, 13 Drawing Sheets

LIQUID EJECTING HEAD AND LIQUID EJECTING APPARATUS

The present application is based on, and claims priority from JP Application Serial Number 2021-014203, filed Feb. 1, 2021, and JP Application Serial Number 2021-184673, filed Nov. 12, 2021, the disclosures of which are hereby incorporated by reference herein in its entirety.

BACKGROUND

1. Technical Field

Embodiments of the present disclosure relate to a liquid ejecting head and a liquid ejecting apparatus.

2. Related Art

A liquid ejecting apparatus equipped with a liquid ejecting head configured to eject liquid such as ink is known. A liquid ejecting head disclosed in JP-A-2018-187846 includes piezoelectric elements for ejecting liquid, a drive circuit that includes switching elements for driving the piezoelectric elements, a wiring member on which the drive circuit is mounted, and a circuit board that is electrically coupled to the wiring member.

Inside the liquid ejecting head, the drive circuit is disposed in a space between the piezoelectric elements and the circuit board. Heat produced from the drive circuit is transferred by air that is present in the space in which the drive circuit is disposed or by metal wiring connected to the drive circuit. However, it is difficult to release the heat produced from the drive circuit to the outside sufficiently by the air or the metal wiring alone. The temperature of the drive circuit might become high due to insufficient heat release. There is a risk that the high temperature might cause damage to the drive circuit. If the performance of the drive circuit is limited in order to prevent the drive circuit from being damaged, the full performance of the liquid ejecting head cannot be expected.

SUMMARY

A liquid ejecting head according to a certain aspect of the present disclosure includes: piezoelectric elements driven to eject liquid from a plurality of nozzles in an ejecting direction; a plurality of pressure chambers in communication with the plurality of nozzles respectively; a diaphragm that defines a wall surface of the plurality of pressure chambers and deforms when driven by the piezoelectric element; a flexible substrate that has a drive circuit electrically coupled to the piezoelectric elements; and a heat release member that is either in contact with an opposite surface of the flexible substrate, the opposite surface being opposite of a surface on which the drive circuit is provided, or in contact with the drive circuit, and conducts heat of the drive circuit to the diaphragm.

A liquid ejecting apparatus according to a certain aspect of the present disclosure includes: the above liquid ejecting head; and a liquid containing unit that contains liquid that is to be supplied to the above liquid ejecting head.

DESCRIPTION OF EXEMPLARY EMBODIMENTS

Figure 1:
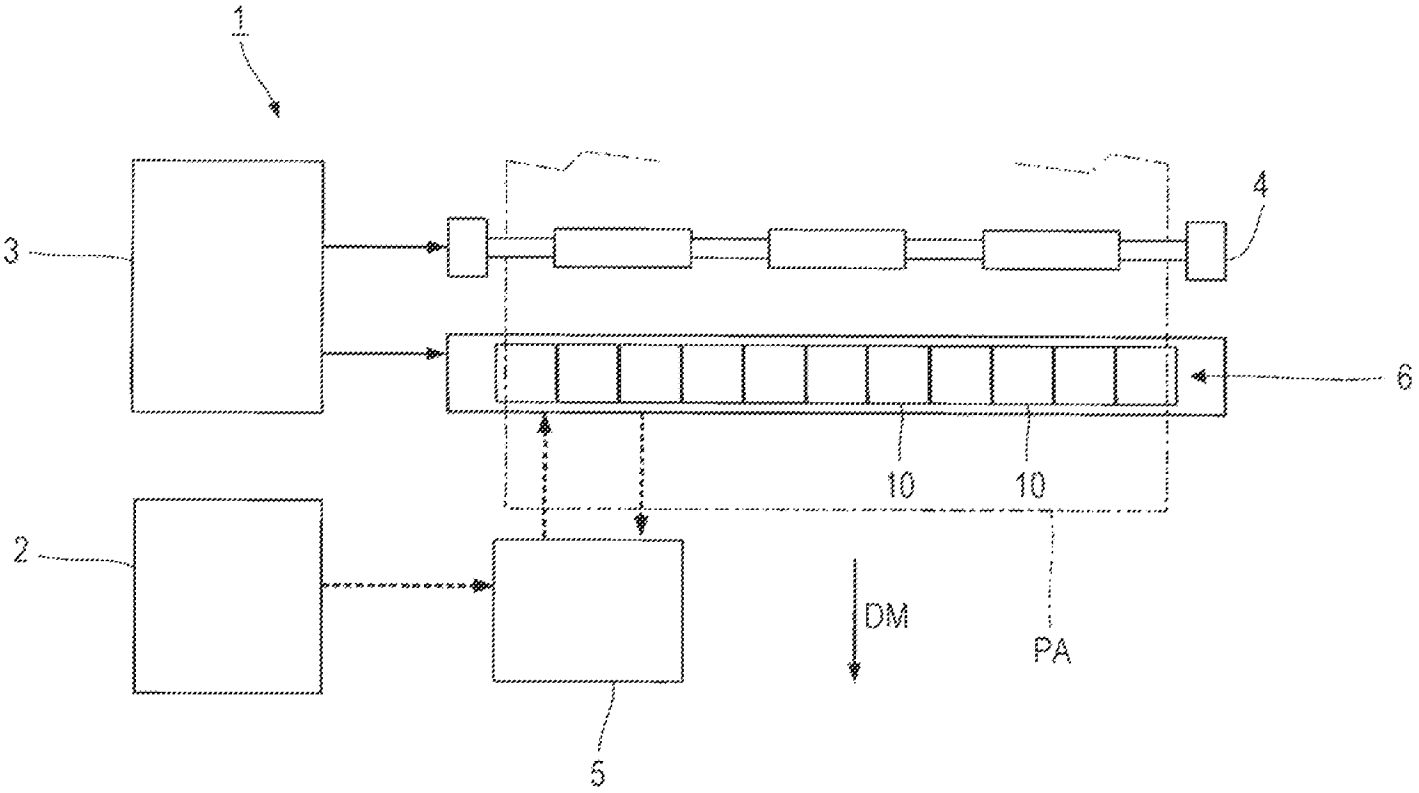
FIG. 1 is a schematic diagram that illustrates a liquid ejecting apparatus according to a first embodiment.

With reference to the accompanying drawings, some exemplary embodiments of the present disclosure will now be explained. In the drawings, the dimensions and scales of components may be made different from those in actual implementation. Since the embodiments described below show some preferred examples of the present disclosure, they contain various technically-preferred limitations. However, the scope of the present disclosure shall not be construed to be limited to the examples described below unless and except where any intention of restriction is mentioned explicitly.

In the description below, three directions that are orthogonal to one another may be referred to as X-axis direction, Y-axis direction, and Z-axis direction. The X-axis direction includes X1 direction and X2 direction, which are the opposite of each other. The X-axis direction is an example of a second direction. The Y-axis direction includes Y1 direction and Y2 direction, which are the opposite of each other. The Y-axis direction is an example of a first direction. The Z-axis direction includes Z1 direction and Z2 direction, which are the opposite of each other. The Z1 direction is the direction going down. The Z2 direction is the direction going up. The Z1 direction is an example of an ejecting direction. In this specification, words "upper", "over", "above", etc. and opposite words "lower", "under", "below", etc. will be used. These words correspond to the meaning of "upper", "over", "above", etc. and "lower", "under", "below", etc. in a normal state of use, in which nozzles of a liquid ejecting apparatus 1 are directed vertically downward.

The X-axis direction, the Y-axis direction, and the Z-axis direction are orthogonal to one another. In an ordinary configuration, the Z-axis direction is along the vertical direction. However, the Z-axis direction does not necessarily have to be along the vertical direction.

FIG. 1 is a schematic diagram that illustrates an example of the configuration of a liquid ejecting apparatus 1 according to a first embodiment. The liquid ejecting apparatus 1 is an ink-jet-type printing apparatus that ejects droplets of ink, which is an example of "liquid", onto a medium PA. The liquid ejecting apparatus 1 according to the present embodiment is a so-called line-type printing apparatus, in which plural nozzles configured to eject ink are provided throughout the entire width of the medium PA. A typical example of the medium PA is printing paper. The medium PA is not limited to printing paper. The medium PA may be a print target made of any material such as, for example, a resin film or a cloth.

As illustrated in FIG. 1, the liquid ejecting apparatus 1 includes a liquid container 2 that contains ink. Some specific examples of the liquid container 2 are: a cartridge that can be detachably attached to the liquid ejecting apparatus 1, a bag-type ink pack made of a flexible film material, an ink tank which can be refilled with ink, etc. Any type of ink may be contained in the liquid container 2. The liquid container 2 is an example of a liquid containing unit.

In an ordinary configuration, the liquid container 2 includes a first liquid container and a second liquid container, though not illustrated. The liquid container 2 may be a single liquid container instead. The first liquid container contains first ink. The second liquid container contains second ink, the type of which is different from the type of the first ink. For example, the color of the first ink and the color of the second ink are different from each other. The first ink and the second ink may be the same type of ink.

The liquid ejecting apparatus 1 includes a control unit 3, a medium transportation mechanism 4, a circulation mechanism 5, and a plurality of liquid ejecting heads 10. The control unit 3 controls the operation of each component of the liquid ejecting apparatus 1. The control unit 3 includes a processing circuit, for example, a CPU (central processing unit) or an FPGA (field programmable gate array), and a storage circuit such as a semiconductor memory. Various kinds of program and data are stored in the storage circuit. The processing circuit realizes various kinds of control by running the program and using the data.

The medium transportation mechanism 4 is controlled by the control unit 3 and transports the medium PA in a transportation direction DM. The medium transportation mechanism 4 includes a transportation roller that is elongated in the width direction of the medium PA and a motor that causes the transportation roller to rotate. The configuration of the medium transportation mechanism 4 is not limited to the illustrated example in which the transportation roller is used. For example, a drum that transports the medium PA in a state in which the medium PA is attracted to the circumferential surface of the drum by an electrostatic force, etc., may be used in place of the transportation roller. Alternatively, an endless belt may be used.

Each liquid ejecting head 10 is controlled by the control unit 3. The liquid ejecting head 10 ejects, from each of a plurality of nozzles toward the medium PA, ink that is supplied from the liquid container 2 via the circulation mechanism 5. The liquid ejecting heads 10 are arranged next to one another in a direction intersecting with the transportation direction DM. These plural heads arranged linearly constitute a line head 6.

Ink contained in the liquid container 2 is supplied to the liquid ejecting heads 10 via the circulation mechanism 5. The circulation mechanism 5 supplies ink to the liquid ejecting heads 10 and collects ink discharged from the liquid ejecting heads 10. The circulation mechanism 5 supplies the collected ink back to the liquid ejecting heads 10. The circulation mechanism 5 includes flow passages for supplying ink to the liquid ejecting heads 10, flow passages for collecting ink discharged from the liquid ejecting heads 10, a sub tank in which the collected ink can be contained, a pump for causing ink to flow, and the like.

Figure 2:
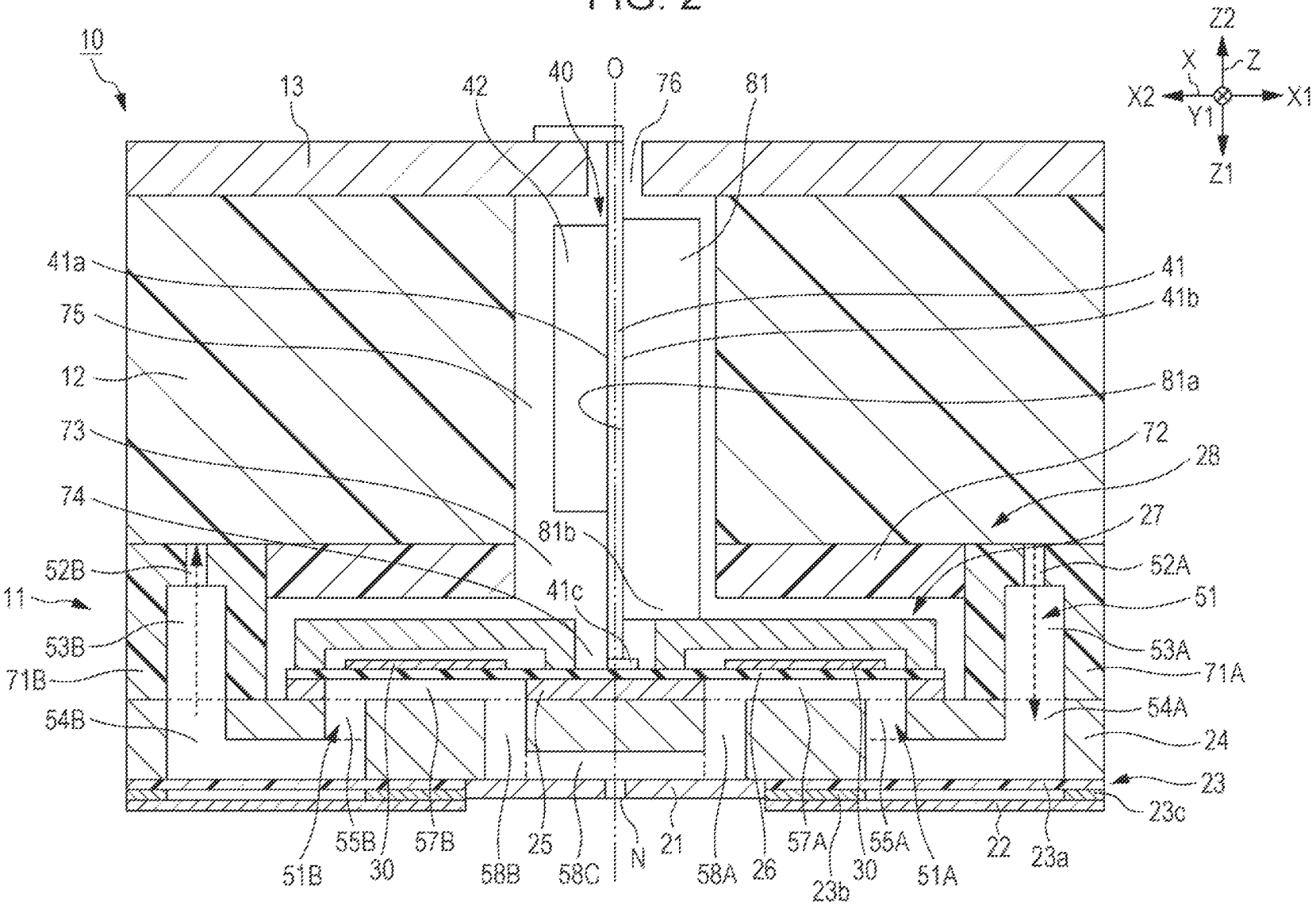
FIG. 2 is a cross-sectional view of a liquid ejecting head.

Next, with reference to FIG. 2, the liquid ejecting head 10 will now be explained. FIG. 2 is a cross-sectional view of the liquid ejecting head 10. The liquid ejecting head 10 includes a plurality of head chips 11, a holder 12 that holds the plurality of head chips 11, a circuit board 13 disposed on the holder 12, and a fixing plate 22 to which the plurality of head chips 11 is fixed. In FIG. 2, a center line O that goes through the X-directional center of any head chip 11 among the plurality of head chips 11 held by the holder 12 and extends in the Z-axis direction is illustrated.

The head chip 11 includes a nozzle plate 21, a compliance substrate 23, a communication plate 24, a pressure chamber forming plate 25, a diaphragm 26, and piezoelectric actuators (piezoelectric elements) 30. The head chip 11 further includes a protective substrate 27, a case 28, and a COF 40. COF is an acronym for Chip On Film. Although the holder 12 is configured to hold the plurality of head chips 11 in the present embodiment, the number of the head chips 11 held by the holder 12 may be one. In the present embodiment, the holder 12 is made of resin such as, for example, PE (polyethylene), PP (polypropylene), or PPS (polyphenylene sulfide).

The nozzle plate 21 and the compliance substrate 23 are disposed at the bottom of the head chip 11. The communication plate 24 is disposed on the nozzle plate 21 and the compliance substrate 23. The pressure chamber forming plate 25 is disposed on the communication plate 24. The diaphragm 26 is disposed on the pressure chamber forming plate 25. The plurality of piezoelectric actuators 30 is disposed on the diaphragm 26. The protective substrate 27 is disposed on and over the diaphragm 26 in such a way as to cover the plurality of piezoelectric actuators 30. The case 28 is disposed on and over the communication plate 24 in such a way as to cover the protective substrate 27. Other members may be disposed between these members.

Figure 3:
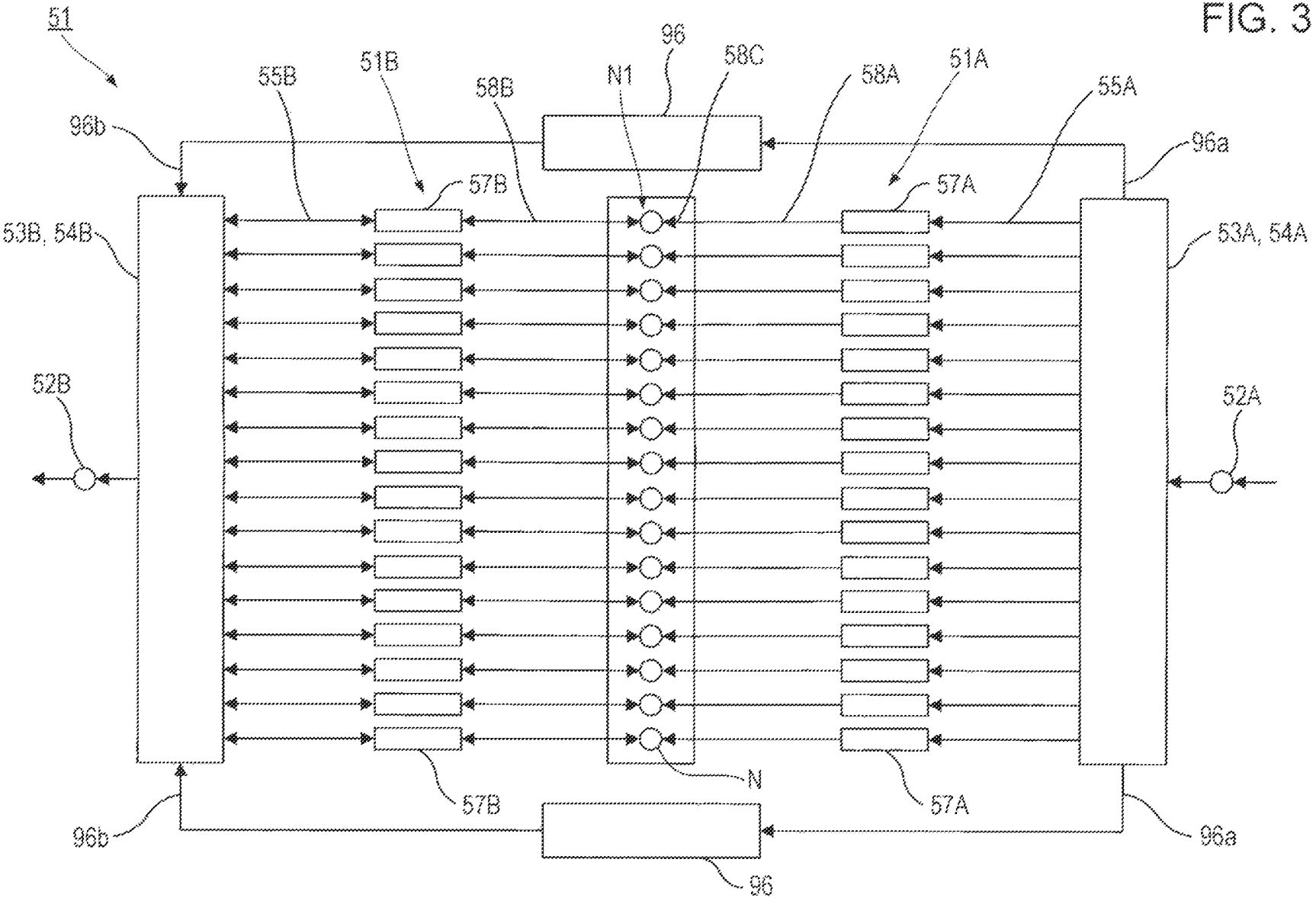
FIG. 3 is a schematic view of an ink flow passage inside a head chip.
Figure 4:
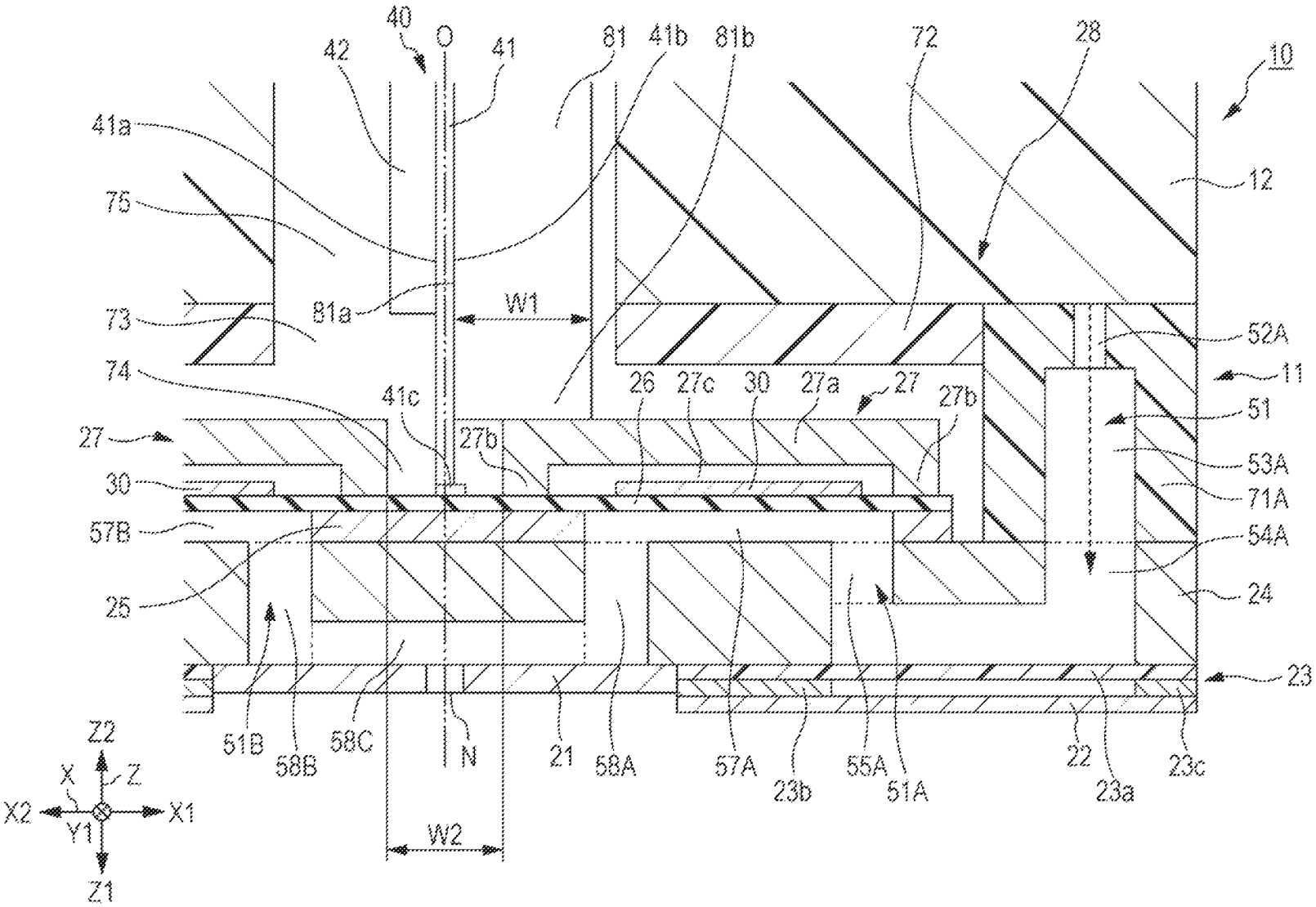
FIG. 4 is an enlarged cross-sectional view of an essential part of the head chip.

FIG. 3 is a schematic view of an ink flow passage 51 inside the head chip 11. FIG. 4 is an enlarged cross-sectional view of an essential part of the head chip 11. In FIG. 4, the supply-side part of the ink flow passage 51 is mainly illustrated. As illustrated in FIGS. 2, 3, and 4, the flow passage 51 through which ink flows is formed inside the head chip 11. The flow passage 51 formed inside the head chip 11 includes a supply inlet 52A, a discharge outlet 52B, common chambers 53A, 53B, 54A, and 54B, relay flow passages 55A and 55B, pressure chambers 57A and 57B, and communication flow passages 58A, 58B, and 58C. A nozzle N is in communication with the communication flow passage 58C. In FIGS. 2 and 4, ink flow passages formed inside the holder 12 are not illustrated.

Among those constituting the ink flow passage 51, the supply inlet 52A, the discharge outlet 52B, and the common chambers 53A and 53B are formed in the case 28. The common chamber 53A, 53B is an example of a common flow passage. The case 28 is an example of a flow passage member that has a common flow passage. The common chambers 54A and 54B, the relay flow passages 55A and 55B, and the communication flow passages 58A, 58B, and 58C are formed in the communication plate 24. The pressure chambers 57A and 57B are formed in the pressure chamber forming plate 25.

As illustrated in FIG. 2, the case 28 has a common chamber forming portion 71A, a common chamber forming portion 71B, and a cover portion 72. The cover portion 72 is located at the center of the case 28 in the X-axis direction. The common chamber forming portion 71A is located on the X1-directional side with respect to the cover portion 72. The common chamber forming portion 71B is located on the X2-directional side with respect to the cover portion 72. Each of the common chamber forming portion 71A and the common chamber forming portion 71B protrudes beyond the cover portion 72 in the Z1 direction. The case 28 is made of resin such as, for example, PE (polyethylene), PP (polypropylene), or PPS (polyphenylene sulfide). The case 28 may be made of other material. For example, the case 28 may be made of silicon, or stainless steel or any other kind of metal.

The cover portion 72 has a rectangular shape as viewed in the Z-axis direction. There is an opening 73 at the center of the cover portion 72 in the X-axis direction. There is a space on the Z1-directional side of the cover portion 72. In this space, the pressure chamber forming plate 25, the diaphragm 26, the piezoelectric actuators 30, and the protective substrate 27 are disposed.

The common chamber forming portion 71A has the supply inlet 52A and the common chamber 53A. The common chamber forming portion 71B has the discharge outlet 52B and the common chamber 53B. The common chamber 53A is continuous in the Y-axis direction. The common chamber 53B is also continuous in the Y-axis direction. The supply inlet 52A is in communication with the common chamber 53A. The discharge outlet 52B is in communication with the common chamber 53B.

Figure 5:
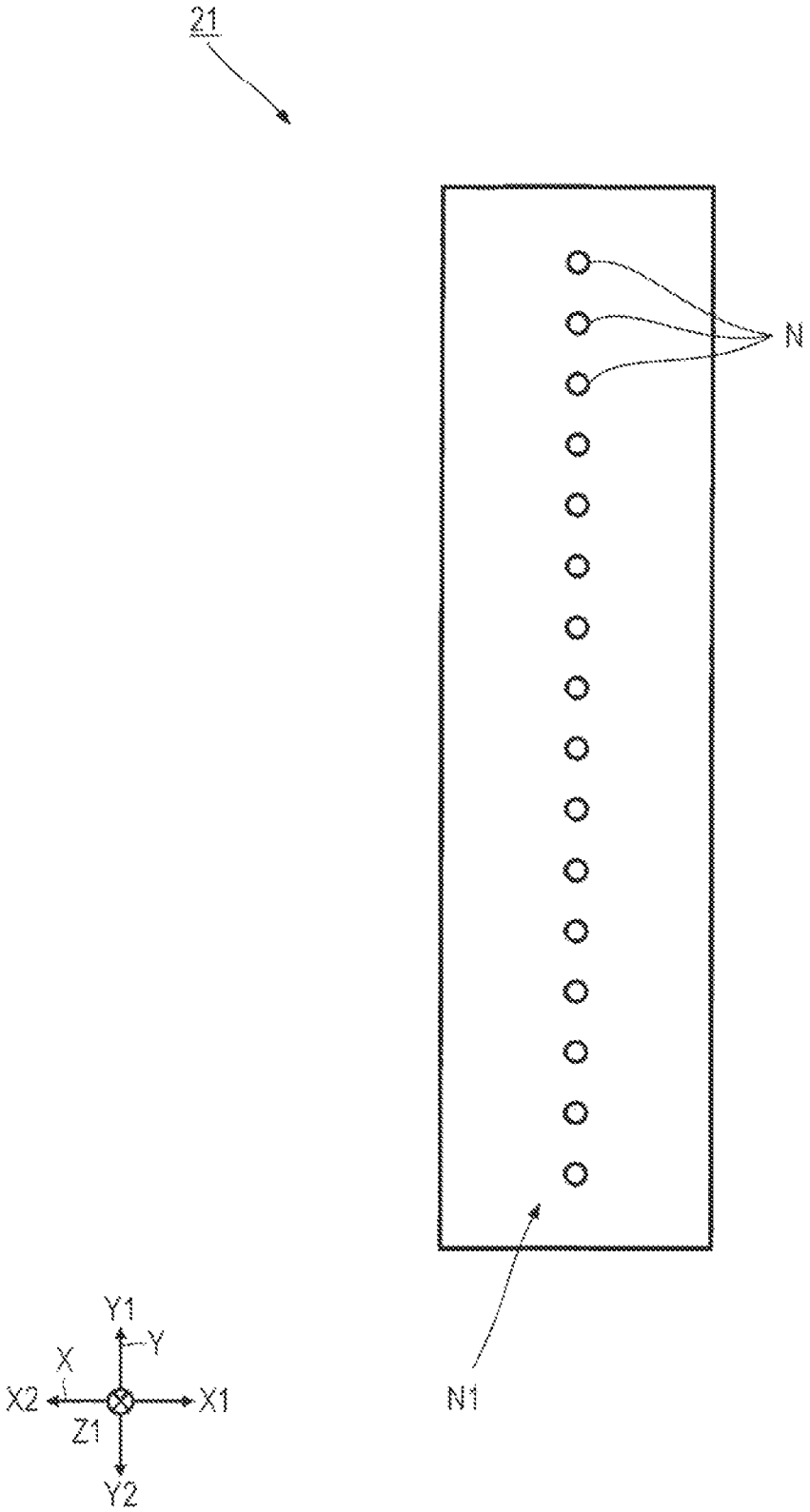
FIG. 5 is a plan view of a nozzle plate.

FIG. 5 is a plan view of the nozzle plate 21. As illustrated in FIG. 5, the nozzle plate 21 has a rectangular shape as viewed in the Z-axis direction. The nozzle plate 21 has a plurality of nozzles N. These nozzles N are arranged next to one another in the Y-axis direction to constitute a nozzle row N1.

The fixing plate 22 illustrated in FIGS. 2 and 4 has an opening that is formed in such a way that the edges of the opening surround the nozzle plate 21 as viewed in the Z-axis direction. The opening is provided for each of the plurality of head chips 11.

The compliance substrate 23 is disposed on the Z2-directional side with respect to the fixing plate 22. The compliance substrate 23 is disposed in such a way as to surround the nozzle plate 21 as viewed in the Z-axis direction. The common chambers 54A and 54B are located on the Z2-directional side with respect to the compliance substrate 23.

The compliance substrate 23 includes a flexible film 23*a*, a supporting plate 23*b*, and a supporting plate 23*c*. The supporting plate 23*b* and the supporting plate 23*c* are disposed on the Z2-directional side with respect to the fixing plate 22. The supporting plate 23*b* and the supporting plate 23*c* are at a distance from each other in the X-axis direction. There is a space between the supporting plate 23*b* and the supporting plate 23*c* in the X-axis direction. The flexible film 23*a* is disposed on the Z2-directional side with respect to the supporting plate 23*b* and the supporting plate 23*c*. The flexible film 23*a* defines the Z1-side surface of the common chamber 54A, 54B. The flexible film 23*a* deforms due to the pressure of ink, thereby absorbing pressure changes in the ink flow passage 51 inside the head chip 11.

Figure 6:
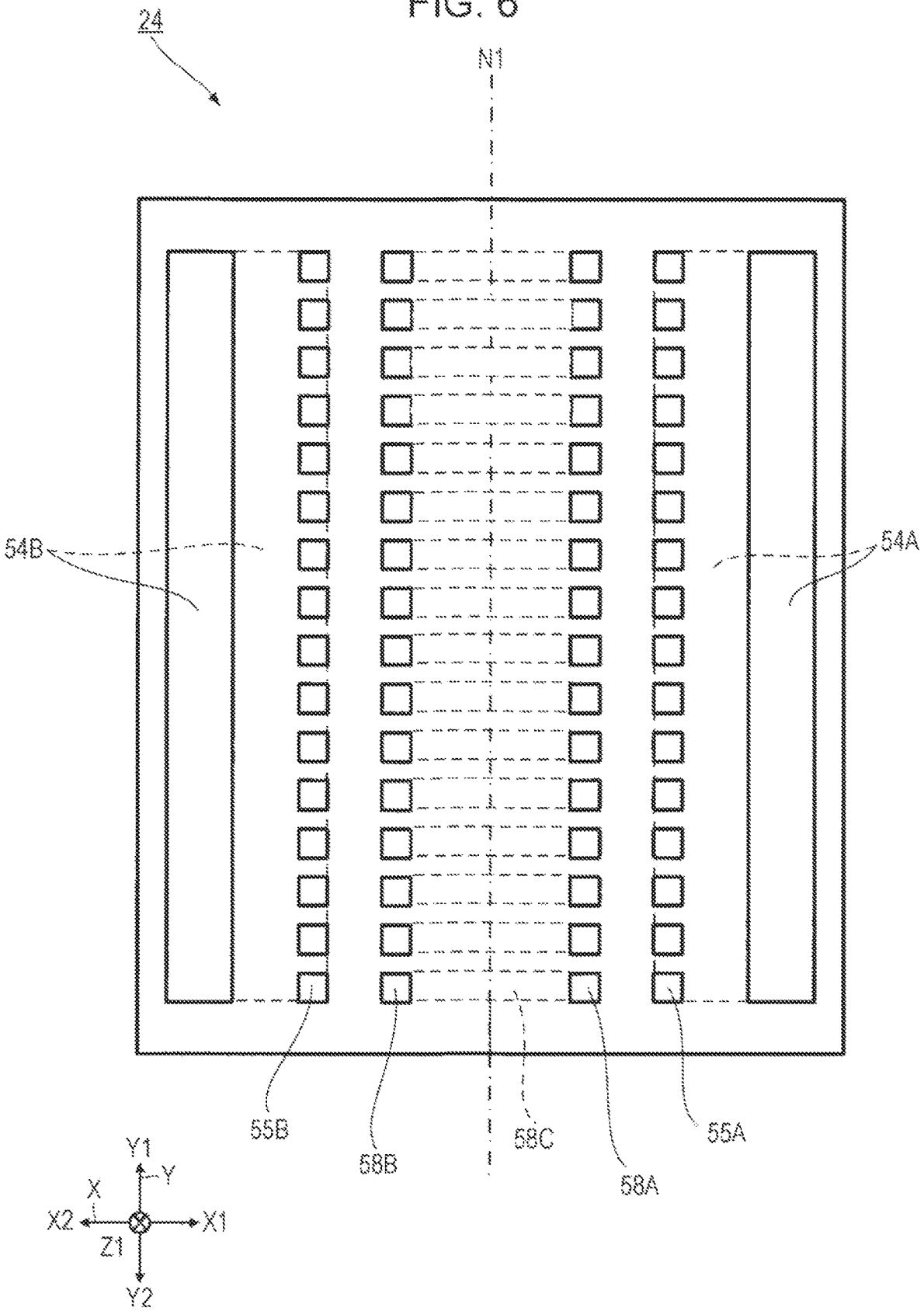
FIG. 6 is a plan view of a communication plate.

FIG. 6 is a plan view of the communication plate 24. In FIG. 6, the communication plate 24 viewed in the Z1 direction is illustrated. As illustrated in FIGS. 2 and 6, the common chambers 54A and 54B, the relay flow passages 55A and 55B, and the communication flow passages 58A, 58B, and 58C are formed in the communication plate 24 as described earlier. A dot-and-dash line corresponding to the arrangement of nozzles constituting the nozzle row N1 is shown in FIG. 6.

The common chamber 54A is located at an X1-side end region. The common chamber 54B is located at an X2-side end region. The common chamber 54A is continuous in the Y-axis direction. The common chamber 54B is also continuous in the Y-axis direction. The common chamber 54A, 54B includes an opening portion and a groove portion. The opening portion has a through-hole structure going in the Z-axis direction. The groove portion is formed in the Z1-side surface of the communication plate 24. In FIG. 6, the opening portion of the common chamber 54A, 54B having a through-hole structure going in the Z-axis direction is indicated by solid-line illustration, and the groove portion of the common chamber 54A, 54B formed in the Z1-side surface of the communication plate 24 is indicated by broken-line illustration. The common chamber 53A is in communication with the common chamber 54A in the Z-axis direction. The common chamber 53B is in communication with the common chamber 54B in the Z-axis direction.

The relay flow passage 55A and the relay flow passage 55B are provided for each of the plurality of nozzles N. The relay flow passage 55A, 55B extends in the Z-axis direction. The relay flow passage 55A extends in the Z2 direction from the X2-side end of the common chamber 54A. The relay flow passage 55B extends in the Z2 direction from the X1-side end of the common chamber 54B. The relay flow passages 55A are arranged at a predetermined pitch in the Y-axis direction. The relay flow passages 55B are arranged at a predetermined pitch in the Y-axis direction.

The relay flow passage 55A is in communication with the X2-side end of the common chamber 54A. The relay flow passage 55A includes an opening portion that has a through-hole structure going in the Z-axis direction. The pressure chamber 57A is in communication with the Z2-side end of the relay flow passage 55A.

The relay flow passage 55B is in communication with the X1-side end of the common chamber 54B. The relay flow passage 55B includes an opening portion that has a through-hole structure going in the Z-axis direction. The pressure chamber 57B is in communication with the Z2-side end of the relay flow passage 55B.

The communication flow passage 58A is located on the X2-directional side with respect to the relay flow passage 55A. The communication flow passage 58A is in communication with the X2-side end of the pressure chamber 57A. The communication flow passage 58A extends in the Z1 direction from the pressure chamber 57A. The communication flow passage 58A includes an opening portion that has a through-hole structure going in the Z-axis direction.

The communication flow passage 58B is located on the X1-directional side with respect to the relay flow passage 55B. The communication flow passage 58B is in communication with the X1-side end of the pressure chamber 57B. The communication flow passage 58B extends in the Z1 direction from the pressure chamber 57B. The communication flow passage 58B includes an opening portion that has a through-hole structure going in the Z-axis direction.

The communication flow passage 58C extends in the X-axis direction and provides communication between the communication flow passages 58A and 58B. Each of the plurality of communication flow passages 58C is in communication with the corresponding one of the plurality of nozzles N.

The communication plate 24 can be manufactured using, for example, a monocrystalline silicon substrate. The communication plate 24 may be made of any other material such as metal or ceramic. However, if the case 28 and the holder 12 are made of resin, it will be preferable to use a material that has a higher thermal conductivity than the thermal conductivity of the case 28 and the thermal conductivity of the holder 12.

Figure 7:
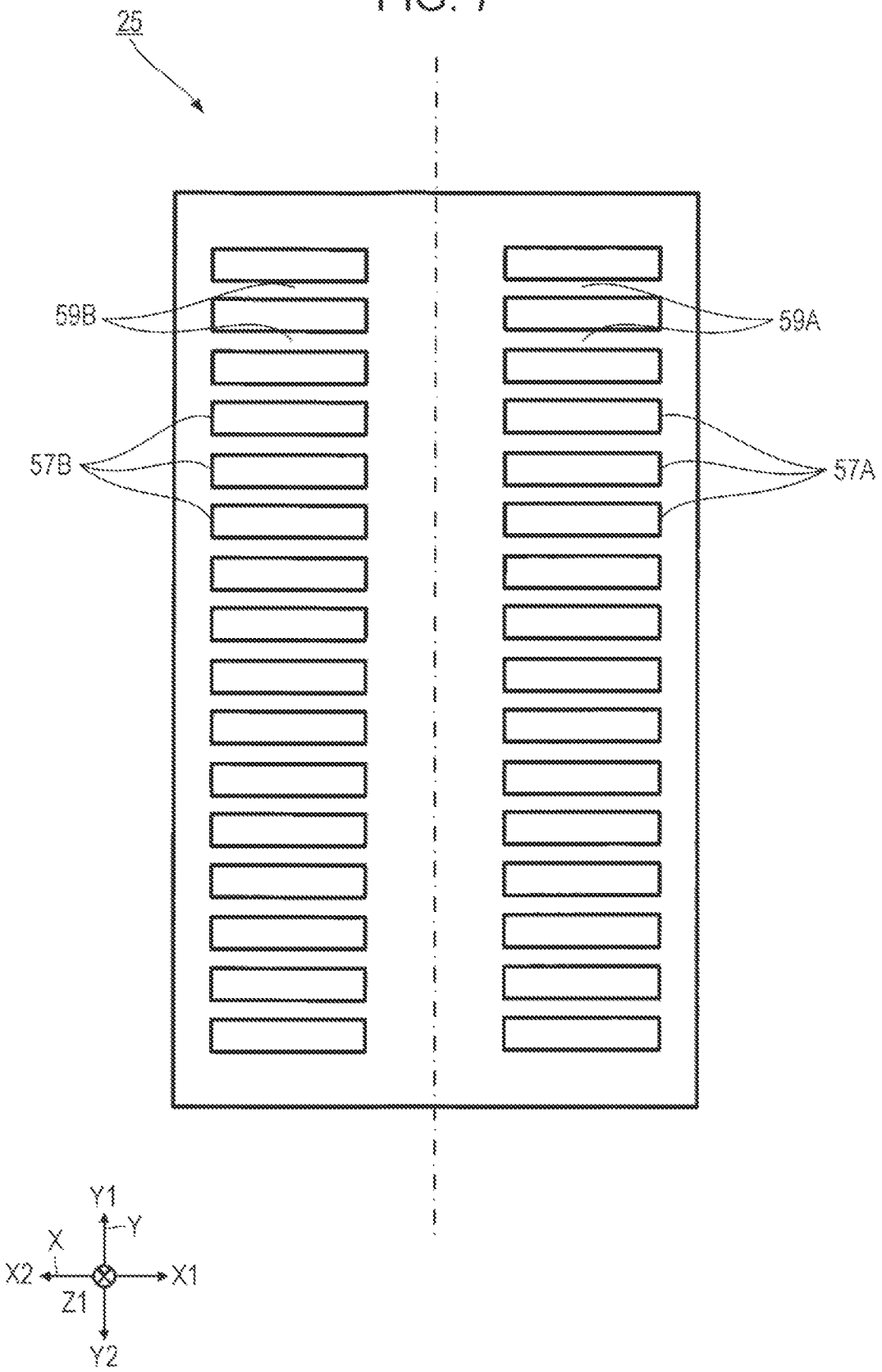
FIG. 7 is a plan view of a pressure chamber forming plate.

FIG. 7 is a plan view of the pressure chamber forming plate 25. In FIG. 7, the pressure chamber forming plate 25 viewed in the Z1 direction is illustrated. As illustrated in FIGS. 2 and 7, the pressure chamber forming plate 25 has a plurality of pressure chambers 57A and 57B. The pressure chamber 57A and the pressure chamber 57B are at a distance from each other in the X-axis direction. The pressure chamber 57A and the pressure chamber 57B are provided for each of the plurality of nozzles N. The pressure chambers 57A are partitioned from one another by a plurality of partition walls 59A each of which extends in the X-axis direction and the Z-axis direction. The pressure chambers 57A are arranged at a predetermined pitch in the Y-axis direction. The pressure chambers 57B are partitioned from one another by a plurality of partition walls 59B each of which extends in the X-axis direction and the Z-axis direction. The pressure chambers 57B are arranged at a predetermined pitch in the Y-axis direction.

The pressure chamber 57A extends in the X-axis direction and is in communication with the relay flow passage 55A and the communication flow passage 58A. The pressure chamber 57B extends in the X-axis direction and is in communication with the relay flow passage 55B and the communication flow passage 58B. The pressure chamber forming plate 25 can be manufactured using, for example, a monocrystalline silicon substrate. The pressure chamber forming plate 25 may be made of any other material such as metal or ceramic. However, if the case 28 and the holder 12 are made of resin, it will be preferable to use a material that has a higher thermal conductivity than the thermal conductivity of the case 28 and the thermal conductivity of the holder 12.

Figure 8:
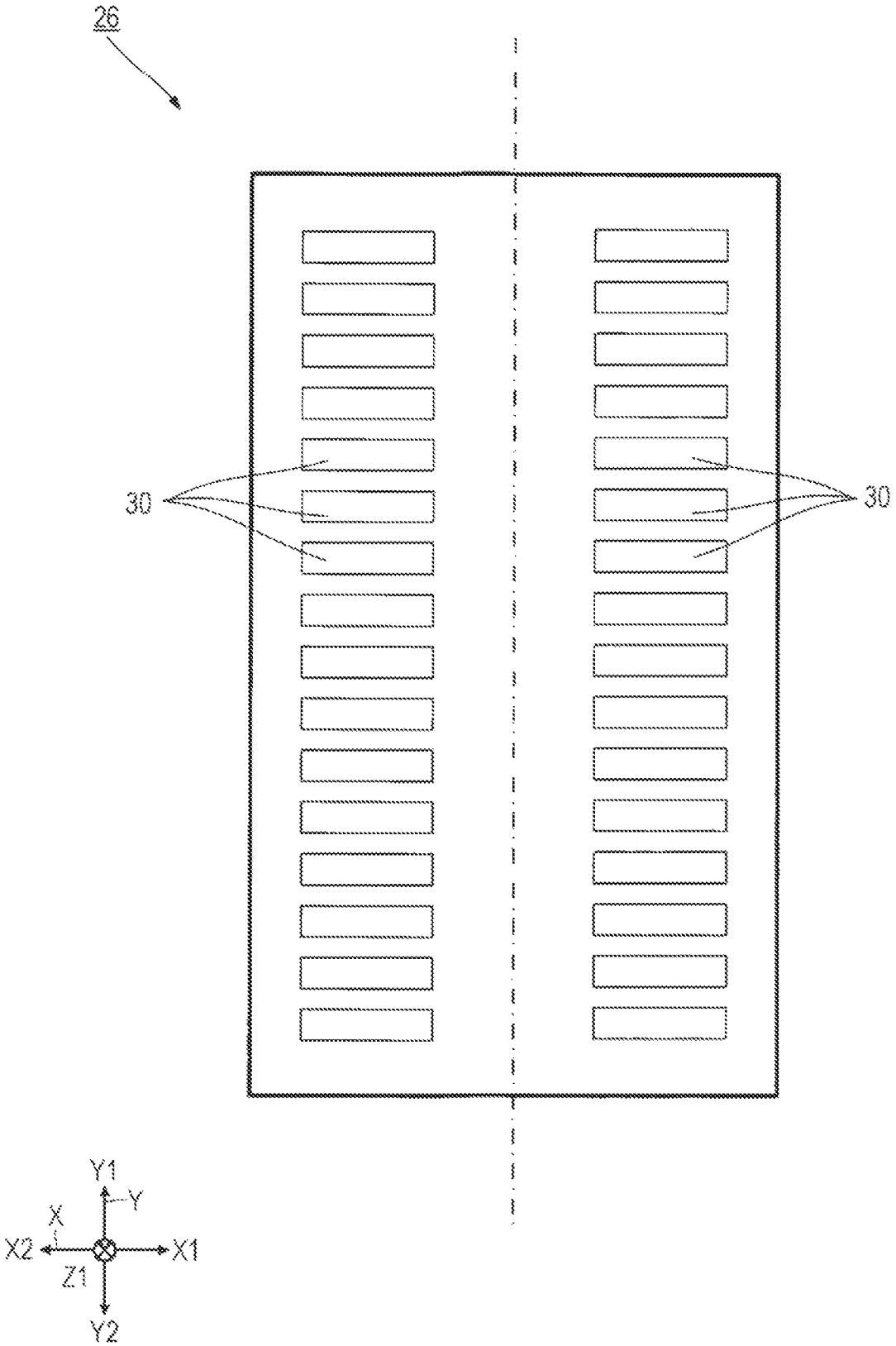
FIG. 8 is a plan view of a diaphragm.
Figure 9:
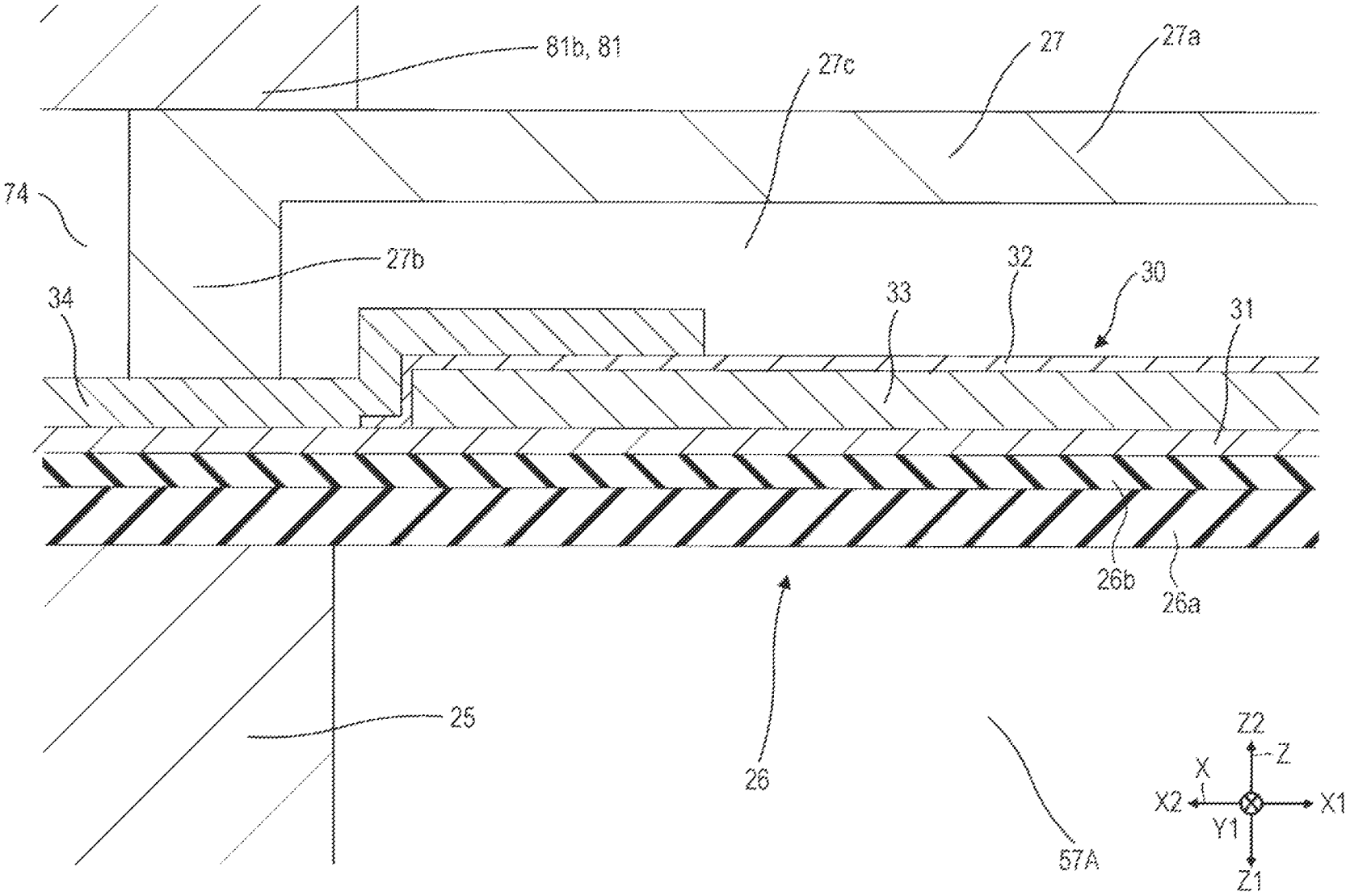
FIG. 9 is an enlarged cross-sectional view of an essential part of the diaphragm and piezoelectric actuators.

FIG. 8 is a plan view of the diaphragm 26. In FIG. 8, the diaphragm 26 viewed in the Z1 direction is illustrated. FIG. 9 is a cross-sectional view of the diaphragm 26 and the piezoelectric actuators 30. The diaphragm 26 illustrated in FIGS. 8 and 9 is disposed on the upper surface of the pressure chamber forming plate 25. The thickness direction of the diaphragm 26 is along the Z axis. The diaphragm 26 covers the openings of the pressure chamber forming plate 25. The portion, of the diaphragm 26, covering the openings of the pressure chamber forming plate 25 constitutes the ceiling, that is, top wall surface, of the pressure chambers 57. The diaphragm 26 includes a plurality of insulation layers. More specifically, the diaphragm 26 includes an insulation layer 26*a* made of silicon dioxide ($SiO_2$) and an insulation layer 26*b* made of zirconium dioxide ($ZrO_2$). The insulation layer 26*a* is formed on the pressure chamber forming plate 25. The insulation layer 26*b* is formed on the insulation layer 26*a*. The diaphragm 26, or a part of the diaphragm 26, may be formed integrally with the pressure chamber forming plate 25. For example, if the pressure chamber forming plate 25 is made of silicon, recesses that will serve as the pressure chambers 57 may be formed by etching one surface of a monocrystalline silicon substrate, and the insulation layer 26*a* made of silicon dioxide ($SiO_2$) may be formed by oxidizing the bottom surface of the recess-formed portion.

The diaphragm 26 is driven by the piezoelectric actuator 30 and vibrates in the Z-axis direction. The total thickness of the diaphragm 26 is, for example, 2 μm or less. The total thickness of the diaphragm 26 may be 15 μm or less, 40 μm or less, or 100 μm or less. For example, if the total thickness of the diaphragm 26 is 15 μm or less, a resin layer may be included. The diaphragm 26 may be made of metal. Examples of the metal are: stainless steel, nickel, or the like. If the diaphragm 26 is made of metal, the thickness of the diaphragm 26 may be 15 μm or more and 1,000 μm or less.

The plurality of piezoelectric actuators 30 is disposed on, of the diaphragm 26, a portion constituting the Z2-side wall surface of the plurality of pressure chambers 57A, and on, of the diaphragm 26, a portion constituting the Z2-side wall surface of the plurality of pressure chambers 57B. The plurality of piezoelectric actuators 30 is provided such that they correspond to the plurality of pressure chambers 57A, 57B respectively. The piezoelectric actuator 30 includes a first electrode 31, a piezoelectric layer 33, and a second electrode 32. The first electrode 31, the piezoelectric layer 33, and the second electrode 32 are stacked in this order on the diaphragm 26. The first electrode 31 is an individual electrode. The second electrode 32 is a common electrode. The first electrode 31 may be configured as a common electrode. The second electrode 32 may be configured as an individual electrode.

The first electrodes 31 are arranged at a predetermined pitch in the Y-axis direction. Each of the plurality of first electrodes 31 is located at a position overlapping with the corresponding one of the plurality of pressure chambers 57A, 57B as viewed in the Z-axis direction. The first electrode 31 has a predetermined length in the X-axis direction, and extends inward toward the center line O from the position over the pressure chamber 57A, 57B. The center line O is illustrated in FIGS. 2 and 4.

The first electrode 31 includes, for example, an electrode layer containing a conductive material having a low resistance such as platinum (Pt) or iridium (Ir), etc., and a ground layer containing titanium (Ti). The electrode layer may be made of oxide such as, for example, strontium ruthenate ($SrRuO_3$), lanthanum nickelate ($LaNiO_3$), etc.

The piezoelectric layer 33 is formed on the first electrodes 31. The piezoelectric layer 33 is disposed in such a way as to cover the plurality of first electrodes 31. The piezoelectric layer 33 is a band-shaped dielectric film extending in the Y-axis direction.

The second electrode 32 is formed on the piezoelectric layer 33. The second electrode 32 extends in the Y-axis direction in such a way as to cover the plurality of first electrodes 31, with the piezoelectric layer 33 sandwiched therebetween. The second electrode 32 includes, for example, an electrode layer containing a conductive material having a low resistance such as Pt or Ir, etc., and a ground layer containing Ti. The electrode layer may be made of oxide such as, for example, $SrRuO_3$, $LaNiO_3$, etc.

The portion, of the piezoelectric layer 33, sandwiched between the first electrode 31 and the second electrode 32 in the Z-axis direction serves as a drive region. The drive region overlaps with the pressure chamber 57A, 57B as viewed in the Z-axis direction.

A lead electrode 34 is electrically coupled to the piezoelectric actuator 30. Each of the plurality of lead electrodes 34 is provided for the corresponding one of the plurality of first electrodes 31. The lead electrode 34 extends in the X-axis direction and is wired to reach the inside of an opening 74 of the protective substrate 27. Though the opening 74 is illustrated in FIGS. 2 and 4, the illustration of the lead electrode 34 is omitted in FIGS. 2 and 4. The opening 74 goes through the protective substrate 27 in the Z-axis direction. The lead electrode 34 is electrically coupled to the COF 40 inside the opening 74.

The lead electrode 34 is made of a conductive material having a lower resistance than that of the first electrode 31. For example, the lead electrode 34 is a conductive pattern having a layered structure obtained by forming a conductive film made of gold (Au) on the surface of a conductive film made of nichrome (NiCr).

Figure 10:
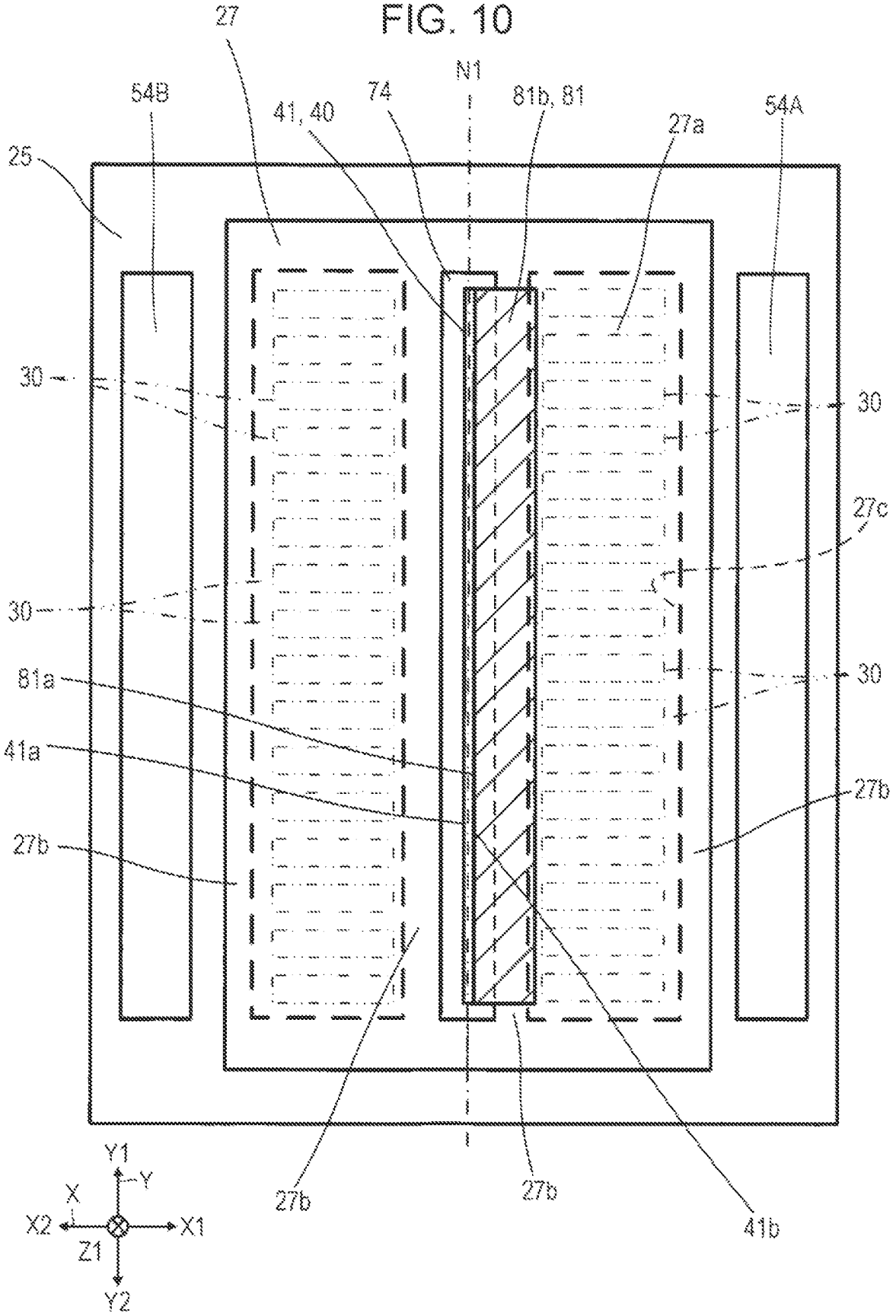
FIG. 10 is a plan view of a protective substrate disposed over the communication plate.

FIG. 10 is a plan view of the protective substrate 27. The protective substrate 27 disposed over the pressure chamber forming plate 25 is illustrated in FIG. 10. In FIG. 10, the plurality of piezoelectric actuators 30 is indicated by virtual-line illustration.

As illustrated in FIGS. 4 and 10, the protective substrate 27 is disposed in such a way as to cover the plurality of piezoelectric actuators 30 from the Z2-directional side. The protective substrate 27 has a rectangular shape as viewed in the Z-axis direction. The protective substrate 27 protects the plurality of piezoelectric actuators 30 and enhances the mechanical strength of the pressure chamber forming plate 25 and the diaphragm 26. The protective substrate 27 is a member in which the flow passage 51 through which a liquid flows is not formed.

The protective substrate 27 is made of metal, or ceramic. Examples of the metal are: stainless steel, aluminum, or copper. Examples of the ceramic are: silicon dioxide ($SiO_2$), silicon carbide (SiC), aluminum nitride (AlN), sapphire ($AL_2O_3$), aluminium oxide ($AL_2O_3$), silicon nitride ($Si_3N_4$), cermet, yttrium oxide ($Y_2O_3$). For example, the protective substrate 27 preferably has a thermal conductivity of 1.0 W/m·K or more at room temperature (20° C.). Furthermore, the protective substrate 27 more preferably has a thermal conductivity of 10.0 W/m·K or more at room temperature (20° C.). In this embodiment, the protective substrate 27 is made of silicon dioxide ($SiO_2$).

The protective substrate 27 includes a plate portion 27*a* and a leg portion 27*b*. The plate portion 27*a* is disposed in such a way as to cover the plurality of piezoelectric actuators 30 in the Z-axis direction. The plate portion 27*a* has a rectangular shape as viewed in the Z-axis direction. The plate portion 27*a* matches the contour of the protective substrate 27 as viewed in the Z1 direction. The leg portion 27*b* is formed in such a way as to surround the plate portion 27*a* as viewed in the Z-axis direction. The leg portion 27*b* protrudes in the Z1 direction from the plate portion 27*a*. The leg portion 27*b* is located on one side and the opposite side in the X-axis direction and on one side and the opposite side in the Y-axis direction with respect to a group of the piezoelectric actuators 30 arranged next to one another in the Y-axis direction. The leg portion 27*b* is bonded to the diaphragm 26. As illustrated in FIG. 9, at a position where the lead electrode 34 is provided, the lead electrode 34 exists between the leg portion 27*b* and the diaphragm 26. The protective substrate 27 is bonded to the diaphragm 26 by means of, for example, an adhesive.

The protective substrate 27 has a concave portion 27*c* for housing the plurality of piezoelectric actuators 30. The concave portion 27*c* is a space located on the Z1-directional side with respect to a non-leg portion of the plate portion 27*a* where the leg portion 27*b* is not formed, and is a space enclosed by the leg portion 27*b*. The concave portion 27*c* is formed in such a way as to be recessed in the Z2 direction from the Z1-side surface of the protective substrate 27.

As illustrated in FIG. 10, there is an opening 74 at the center of the protective substrate 27 in the X-axis direction. The opening 74 goes through the protective substrate 27 in the Z-axis direction. The opening 74 is elongated in the Y-axis direction. The length of the opening 74 in the Y-axis direction corresponds to the length of the nozzle row N1.

As illustrated in FIG. 2, the holder 12 has an opening 75 going therethrough in the Z-axis direction. The opening 75 is elongated in the Y-axis direction. The length of the opening 75 in the Y-axis direction corresponds to the length of the nozzle row N1. The width of the opening 75 in the X-axis direction is approximately the same as the width of the opening 73 of the case 28 in the X-axis direction.

The circuit board 13 has an opening 76 going therethrough in the Z-axis direction. The opening 76 is elongated in the Y-axis direction. The length of the opening 76 in the Y-axis direction corresponds to the length of the nozzle row N1. The width of the opening 76 in the X-axis direction is less than the width of the opening 75 of the holder 12 in the X-axis direction.

The COF 40 includes a flexible wiring board 41 and a drive circuit 42. The flexible wiring board 41 is a wiring board that has flexibility. The flexible wiring board 41 is, for example, an FPC (Flexible Printed Circuit). The flexible wiring board 41 may be, for example, an FFC (Flexible Flat Cable).

The flexible wiring board 41 is inserted into the opening 76 of the circuit board 13 from the Z2-directional side thereof, and extends in the Z-axis direction. The flexible wiring board 41 extends through the opening 75 of the holder 12 and the opening 73 of the case 28 into the opening 74 of the protective substrate 27.

The Z2-side end of the flexible wiring board 41 is electrically coupled to the circuit board 13. A connection terminal 41*c*, which is the Z1-side end of the flexible wiring board 41, is electrically coupled to the lead electrodes 34 inside the opening 74. The Z1-side end of the flexible wiring board 41 may be, at a portion where no lead electrode 34 is provided, bonded to the diaphragm 26.

The thickness direction of the flexible wiring board 41 is, for example, along the X axis. The thickness direction of the flexible wiring board 41 may be inclined with respect to the X axis. The flexible wiring board 41 has a predetermined length in the Y-axis direction. The length of the flexible wiring board 41 in the Y-axis direction corresponds to, for example, the length of the nozzle row N1 in the Y-axis direction.

The flexible wiring board 41 has one surface 41*a* and the other surface 41*b*. A wiring portion is provided on the one surface 41*a*. The surface 41*a* is, for example, the X2-side surface of the flexible wiring board 41. No wiring portion is provided on the other surface 41*b*. The surface 41*b* is, for example, the X1-side surface of the flexible wiring board 41. The surface 41*b* is the opposite surface, which is the opposite of the surface 41*a* on which the drive circuit 42 is provided.

The drive circuit 42 is mounted on the flexible wiring board 41. Specifically, the drive circuit 42 is provided on the surface 41*a* of the flexible wiring board 41. The drive circuit 42 is disposed inside, for example, the opening 75 of the holder 12. A part of the drive circuit 42 may be disposed inside the opening 73 of the case 28.

The drive circuit 42 includes switching elements for driving the piezoelectric actuators 30. The drive circuit 42 is electrically connected to the control unit 3 via the flexible wiring board 41 and the circuit board 13. The drive circuit 42 receives a drive signal outputted from the control unit 3. The switching element performs switching regarding whether or not to supply the drive signal generated by the control unit 3 to the piezoelectric actuator 30. In accordance with a command signal, the drive circuit 42 supplies a drive voltage or a drive current to the piezoelectric actuator 30 to cause the diaphragm 26 to vibrate.

The liquid ejecting head 10 includes a heat release member 81 for conduction of the heat of the drive circuit 42. The heat release member 81 has, for example, a plate shape. The thickness direction of the heat release member 81 is along the X axis. The thickness direction of the heat release member 81 may be inclined with respect to the X axis. The heat release member 81 is elongated in the Y-axis direction.

The length of the heat release member 81 in the Y-axis direction corresponds to the length of the nozzle row N1 in the Y-axis direction. The length of the heat release member 81 in the Y-axis direction may be approximately the same as the length of the drive circuit 42 in the Y-axis direction. The heat release member 81 may be constituted of a plurality of plate members.

The heat release member 81 is disposed inside the opening 75 of the holder 12 and the opening 73 of the case 28. The heat release member 81 is disposed on the X1-directional side with respect to the flexible wiring board 41. The surface 81*a* of the heat release member 81 is in contact with the surface 41*b* of the flexible wiring board 41. The surface 81*a* of the heat release member 81 is its X2-side surface. The surface 81*a* of the heat release member 81 is closer to the flexible wiring board 41 than its opposite surface is. The heat release member 81 may be bonded to the flexible wiring board 41 by using, for example, an adhesive. Alternatively, for example, a tape, a film, or the like may be used for bonding the heat release member 81 to the flexible wiring board 41. Any other alternative bonding method may be used for bonding the heat release member 81 to the flexible wiring board 41 as long as the heat release member 81 is able to conduct the heat of the drive circuit 42.

The heat release member 81 is in contact with the protective substrate 27. The Z1-side end 81*b* of the heat release member 81 is in contact with a portion, of the protective substrate 27, closer to the pressure chambers 57A. As illustrated in FIG. 10, the heat release member 81 is in contact with a portion, of the protective substrate 27, located on the X1-directional side near the opening 74. More specifically, the heat release member 81 is in contact with a part, of the plate portion 27*a*, located between the opening 74 and the concave portion 27*c* located on the X1-directional side with respect to the opening 74. The heat release member 81 is disposed such that a part of the heat release member 81 overlaps the protective substrate 27 as viewed in the Z1 direction. The heat release member 81 may be bonded to the protective substrate 27 by using, for example, an adhesive. Any other alternative bonding method may be used for bonding the heat release member 81 to the protective substrate 27 as long as the heat release member 81 is able to conduct heat to the protective substrate 27. The heat release member 81 may be merely in contact with the protective substrate 27.

Examples of the material of the heat release member 81 are: metal, or ceramic. Examples of the metal are: stainless steel, aluminum, or copper. Examples of the ceramic are: silicon dioxide ($SiO_2$), silicon carbide (SiC), aluminum nitride (AlN), sapphire ($AL_2O_3$), aluminium oxide ($AL_2O_3$), silicon nitride ($Si_3N_4$), cermet, yttrium oxide ($Y_2O_3$). The heat release member 81 may be made of any other heat-conductive material. For example, the heat release member 81 preferably has a thermal conductivity of 1.0 W/m·K or more at room temperature (20° C.). Furthermore, the heat release member 81 more preferably has a thermal conductivity of 10.0 W/m·K or more at room temperature (20° C.). In this embodiment, the heat release member 81 is made of stainless steel.

As illustrated in FIG. 4, the width W1 of the end portion 81*b* of the heat release member 81 in the X-axis direction may be greater than the width W2 of the opening 74 of the protective substrate 27 in the X-axis direction. The end portion 81*b* is, in the Z-axis direction, an end portion that is closer to the diaphragm 26 than the opposite end portion is. The end portion 81*b* and the connection terminal 41*c* are at a distance from each other in the Z-axis direction. That is, there is a gap between the end portion 81*b* and the connection terminal 41*c* in in the Z-axis direction, meaning that they are not in contact with each other.

Figure 11:
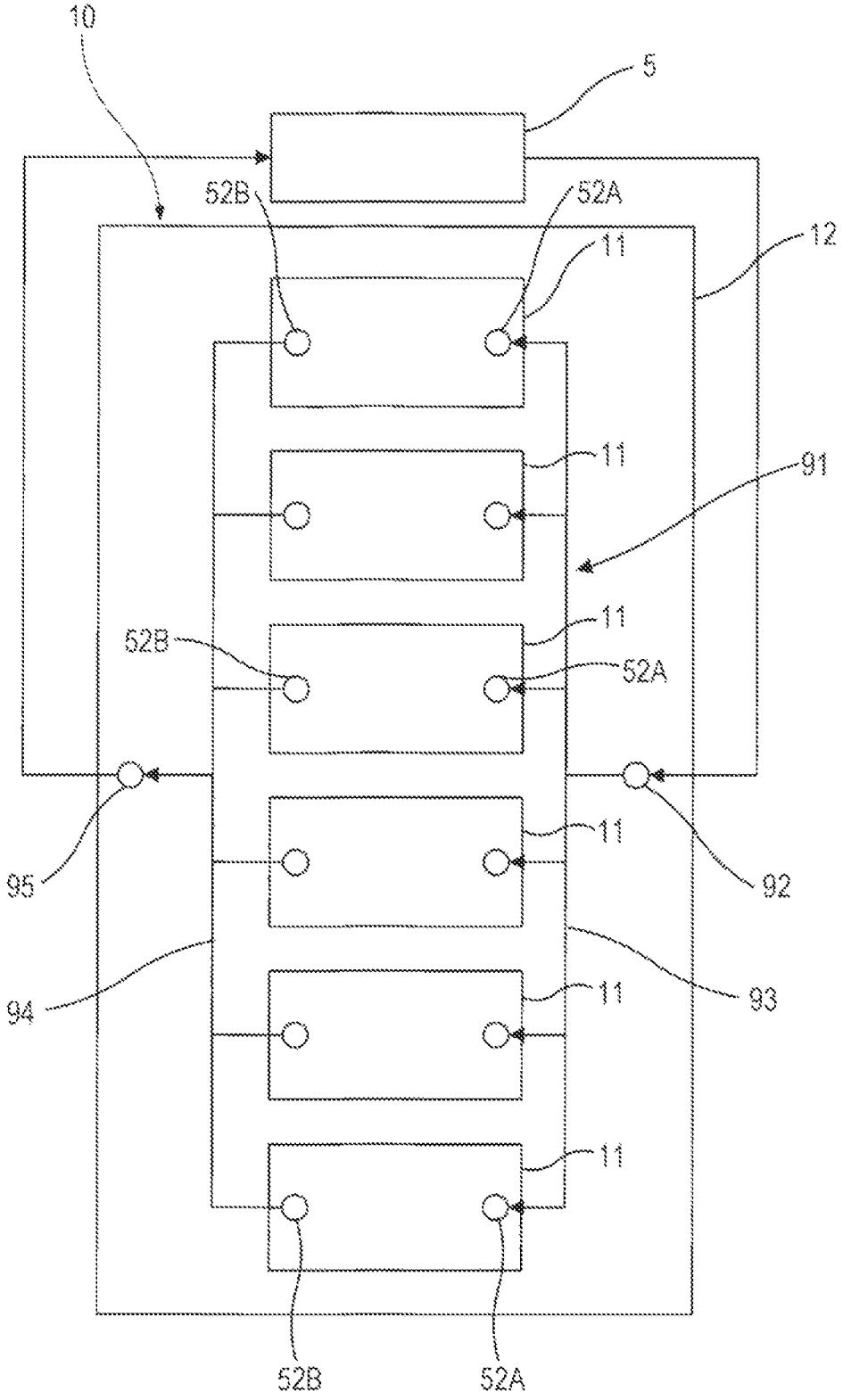
FIG. 11 is a schematic view of an ink flow passage inside a holder.

Next, the flow of ink in the liquid ejecting head 10 will now be explained. FIG. 11 is a schematic view of an ink flow passage 91 inside the holder 12. The flow passage 91 through which ink flows is formed inside the holder 12.

The flow passage 91 of the holder 12 includes a supply inlet 92, a branching flow passage 93, a merging flow passage 94, and a discharge outlet 95. The holder 12 includes a plurality of flow passage members. Grooves and openings are formed in the flow passage members. These grooves and openings constitute the flow passage 91 formed inside the holder 12.

The branching flow passage 93 is in communication with the supply inlet 92 of the holder 12. The branching flow passage 93 is in communication with the supply inlet 52A of each of the plurality of head chips 11. The merging flow passage 94 is in communication with the discharge outlet 52B of each of the plurality of head chips 11. The merging flow passage 94 is in communication with the discharge outlet 95 of the holder 12.

Ink supplied from the circulation mechanism 5 flows into the holder 12 through the supply inlet 92 of the holder 12. The ink that has flowed into the holder 12 is distributed toward the plurality of head chips 11. Each branch flow of the ink goes into the corresponding one of the head chips 11 through the corresponding one of the supply inlets 52A.

A part of the ink that has flowed into the head chip 11 is ejected from the nozzle N. The ink that is not ejected from the nozzle N goes out of the head chip 11 through the discharge outlet 52B. The ink that has flowed out through the discharge outlet 52B of each of the plurality of head chips 11 flows through the merging flow passage 94. These flows of the ink merge to go out through the discharge outlet 95 of the holder 12. The ink that has flowed out through the discharge outlet 95 of the holder 12 is circulated by the circulation mechanism 5, and then flows into the supply inlet 92 of the holder 12 again. The ink is circulated through the circulation mechanism 5 in this way.

As illustrated in FIGS. 2 and 3, ink supplied to the head chip 11 flows into the common chamber 53A through the supply inlet 52A, and next into the common chamber 54A. The ink present in the common chamber 53A, 54A flows into each of the plurality of relay flow passages 55A. The ink present in the common chamber 53A, 54A is distributed to the plurality of pressure chambers 57A.

The ink present in the pressure chamber 57A flows through the communication flow passage 58A to be supplied to the inside of the communication flow passage 58C. A part of the ink present in the communication flow passage 58C is ejected from the nozzle N.

In the head chip 11, there are the following cases: a case where ink is circulated via the communication flow passage 58C; a case where ink is forced out of the pressure chamber 57A, 57B due to the driving of the piezoelectric actuator 30, and the ink is ejected from the nozzle N; and a case where ink is circulated, but not via the communication flow passage 58C.

In the case where ink is circulated via the communication flow passage 58C, the ink present in the communication flow passage 58C flows through the communication flow passage 58B into the pressure chamber 57B. The ink present in the pressure chamber 57B flows through the relay flow passage 55B and is then discharged to the common chamber 53B, 54B. The ink present in the common chamber 53B, 54B flows through the discharge outlet 52B to go out of the head chip 11. The ink that has flowed out of the head chip 11 is circulated via the circulation mechanism 5 as described above.

When the piezoelectric actuator 30 is driven, the diaphragm 26 vibrates, and the internal capacity of the pressure chamber 57A, 57B changes to raise the pressure of ink. The ink present in the pressure chamber 57A flows through the communication flow passage 58A into the communication flow passage 58C and is then ejected from the nozzle N. The ink present in the pressure chamber 57B flows through the communication flow passage 58B into the communication flow passage 58C and is then ejected from the nozzle N.

As illustrated in FIG. 3, a bypass flow passage 96 is connected to the flow passage 51 formed inside the head chip 11. One end 96*a* of the bypass flow passage 96 is connected to the common chamber 53A, 54A. The other end 96*b* of the bypass flow passage 96 is connected to the common chamber 53B, 54B. The bypass flow passage 96 includes a flow passage going on the Y1-directional side to bypass the nozzle row N1 and a flow passage going on the Y2-directional side to bypass the nozzle row N1 as viewed in the Z-axis direction.

A part of the ink present in the common chamber 53A, 54A flows through the bypass flow passage 96 into the common chamber 53B, 54B. The ink present in the common chamber 53B, 54B can be circulated via the circulation mechanism 5 as described above.

The flow resistance of the bypass flow passage 96 is lower than the flow resistance of the circulation passage via the communication flow passage 58C. Therefore, it is easier for the ink present in the common chamber 53A, 54A to flow into the bypass flow passage 96.

Of the ink flow passage 51 formed inside the head chip 11, the portion that goes through the relay flow passage 55A, the pressure chamber 57A, and the communication flow passage 58A into the communication flow passage 58C and is in communication with the nozzle N is included in an individual supply flow passage 51A. Of the flow passage 51, the portion that goes through the communication flow passage 58B, the pressure chamber 57B, and the relay flow passage 55B from the communication flow passage 58C is included in an individual collection flow passage 51B.

Next, with reference to FIGS. 2 and 4, the path of transfer of heat produced from the drive circuit 42 will now be explained. A part of the heat produced from the drive circuit 42 is conducted to the heat release member 81 via the flexible wiring board 41. The heat conducted to the heat release member 81 is conducted to the protective substrate 27 due to thermal conduction.

The heat conducted to the protective substrate 27 is dispersed via the leg portion 27*b* of the protective substrate 27 and is then conducted to the diaphragm 26. The diaphragm 26 defines the Z2-side wall surface of the pressure chamber 57A, 57B and is in contact with the ink present in the pressure chamber 57A, 57B.

The heat conducted to the diaphragm 26 is transferred to the ink inside the pressure chamber 57A, 57B. When the ink forced out of the pressure chamber 57A, 57B is ejected from the nozzle N, the heat conducted to the diaphragm 26 goes out of the liquid ejecting head 10 together with the ink. The heat produced from the drive circuit 42 is released to the outside of the liquid ejecting head 10 in this way.

Moreover, even when no ink is ejected, because of ink circulation, it is possible to disperse the heat transferred from the diaphragm 26 together with the flow of the ink.

In the liquid ejecting head 10 described above, the heat produced from the drive circuit 42 is conducted via the heat release member 81 to the protective substrate 27, next from the protective substrate 27 to the diaphragm 26, and next from the diaphragm 26 to ink. Since the ink is ejected from the nozzle N, it is possible to let out the heat to the outside of the liquid ejecting head 10 together with the ink. By this means, it is possible to let out the heat produced from the drive circuit 42 to the outside of the liquid ejecting head 10. As a result of this heat release, it is possible to suppress a rise in temperature of the drive circuit 42. By suppressing a rise in temperature of the drive circuit 42, it is possible to keep the performance of the drive circuit 42, thereby enabling the liquid ejecting head 10 to eject ink with good performance.

Since the liquid ejecting head 10 includes the plurality of pressure chambers 57A and 57B, the heat conducted to the diaphragm 26 can be transferred to ink via the plurality of partition walls 59A and 59B constituting the wall surfaces of the plurality of pressure chambers 57A and 57B. Of the diaphragm 26, the total area size of the wall surfaces of the plurality of pressure chambers 57A and 57B is larger than, for example, the total area size of the portion, of the wall surfaces of the common chambers 53A, 53B, 54A, and 54B, that is in contact with the ink. Therefore, by performing heat transfer to the ink via the wall surfaces of the pressure chambers 57A and 57B, it is possible to release the heat of the drive circuit 42 efficiently. In particular, for example, if the number of the nozzles N of the nozzle row N1 of the head chip 11 is 300 or more, 300 or more of the pressure chambers 57A and 57B, the number of which corresponds to the number of the nozzles N, will be provided in the head chip 11, and the total area size of the wall surfaces of the plurality of pressure chambers 57A and 57B will be large. Therefore, the effects described above will be remarkable.

The thickness of the diaphragm 26 is less than that of the other members. For example, the thickness of the diaphragm 26 is less than that of the pressure chamber forming plate 25, which is next to the diaphragm 26 in the Z1 direction. Therefore, the diaphragm 26 is not obstructive to the transfer of the heat.

In the liquid ejecting head 10, since the end portion 81*b* of the heat release member 81 is connected to the protective substrate 27, the heat conveyed by conduction by the heat release member 81 is transferred to the protective substrate 27. The protective substrate 27 has the leg portion 27*b* formed in such a way as to enclose the concave portion 27*c*. Since the leg portion 27*b* is connected to the diaphragm 26, the heat conducted to the protective substrate 27 is dispersed by the leg portion 27*b* and is then conducted to the diaphragm 26. The leg portion 27*b* is disposed in such a way as to surround the plurality of pressure chambers 57A, 57B. Therefore, it is possible to conduct the heat to, of the diaphragm 26, the portion located around the pressure chambers 57A, 57B efficiently via the leg portion 27*b*. The heat conducted to the diaphragm 26 is transferred to the ink via the wall surfaces of the plurality of pressure chambers 57A, 57B. Consequently, it is possible to release the heat of the drive circuit 42 efficiently.

In the liquid ejecting head 10, the case 28 is made of resin, the holder 12 is made of resin, and the drive circuit 42 is provided inside the opening 75 of the holder 12. Therefore, as compared with a liquid ejecting head equipped with a case made of metal and a holder made of metal, it is possible to make the weight of the liquid ejecting head 10 lighter. Moreover, if the case 28 and the holder 12 are made of resin, as compared with a structure that includes a case made of metal and a holder made of metal, the cost of manufacturing will be lower. The holder 12 tends to be large in size because it holds the plurality of head chips 11. Therefore, if the holder 12 is made of resin, it will be very advantageous in terms of lighter weight and lower cost as compared with a holder made of metal.

The liquid ejecting head 10 includes the individual supply flow passages 51A and the individual collection flow passages 51B and is capable of causing ink that flows through the flow passage 51 formed inside the head chip 11 to circulate. Since there is a flow of ink inside the flow passage 51, it is possible to prevent the ink whose temperature has risen to stay inside the flow passage 51. The ink to which the heat has been transferred is ejected to the outside of the head chip 11, thereby causing the heat to dissipate. Even when no ink is ejected, it is possible to transfer the heat to the ink via the diaphragm 26, and, consequently, it is possible to release the heat of the drive circuit 42 efficiently.

Since the liquid ejecting head 10 includes the bypass flow passage 96, it is possible to increase the amount of ink that circulates. By this means, it is possible to increase the amount of ink flowing through the common chamber 54A, 54B formed inside the communication plate 24 and increase the amount of heat transferred from the drive circuit 42 to the ink flowing through the common chamber 54A, 54B via the heat release member 81, the diaphragm 26, the pressure chamber forming plate 25, and the communication plate 24.

In the liquid ejecting head 10, the heat release member 81 is disposed on the X1-directional side with respect to the flexible wiring board 41, and the end portion 81*b* of the heat release member 81 is connected to the protective substrate 27 at a position closer to the pressure chambers 57A. Therefore, it is possible to transfer the heat to the ink present in the pressure chamber 57A via a short heat transfer path. Since the ink forced out of the pressure chamber 57A is ejected from the nozzle N, the heat is let out immediately together with the ink. Since ink is supplied from the common chamber 53A, 54A into the pressure chamber 57A, a sufficient amount of ink flow is ensured. When the amount of ink ejected out of the pressure chamber 57A increases, the amount of ink that flows into the pressure chamber 57A from the common chamber 53A, 54A also increases in accordance with it. Therefore, it is possible to release the heat efficiently.

When ink is ejected out of the pressure chamber 57B, ink flows into the pressure chamber 57B from the common chamber 53B, 54B. When the amount of the ink present in the common chamber 53B, 54B decreases, however, no ink is supplied via the discharge outlet 52B. The amount of ink supplied to the pressure chamber 57B from the common chamber 53B, 54B when the amount of ink ejected out of the pressure chamber 57B increases is smaller than the amount of ink supplied to the pressure chamber 57A from the common chamber 53A, 54A. Therefore, it is possible to release the heat more efficiently if the amount of heat transferred to the ink present in the pressure chamber 57A is larger than the amount of heat transferred to the ink present in the pressure chamber 57B. In other words, it is possible to release the heat more efficiently if the end portion 81*b* of the heat release member 81 is connected at a position closer to the pressure chambers 57A, as compared with a case where the end portion 81*b* of the heat release member 81 is connected at a position closer to the pressure chambers 57B.

If the pressure chamber forming plate 25 and the communication plate 24 are made of metal, a part of the heat that has been conducted to the diaphragm 26 is conducted to the pressure chamber forming plate 25 and the communication plate 24. Therefore, it is possible to transfer the heat to the ink via the pressure chamber forming plate 25 and the communication plate 24. For example, it is possible to transfer the heat of the drive circuit 42 to the ink via the wall surfaces of the relay flow passages 55A and 55B and the common chambers 54A and 54B, too. Consequently, it is possible to increase the heat transfer area size and thus release the heat of the drive circuit 42 efficiently.

Since the liquid ejecting head 10 described above is capable of releasing the heat of the drive circuit 42 efficiently, it is possible to prevent the temperature of the drive circuit 42 becoming high and thus avoid the drive circuit 42 from being damaged. Since it is possible to suppress a rise in temperature of the drive circuit 42, there is no need to limit the performance of the drive circuit 42.

For example, if the number of the nozzles N in the head chip 11 increases, the amount of heat produced from the drive circuit 42 tends to increase due to an increase in the number of times of switching in the drive circuit 42. Since the liquid ejecting head 10 offers improved heat release performance and makes it possible to suppress a rise in temperature of the drive circuit 42, it is possible to increase the number of the nozzles N and the number of the piezoelectric actuators 30 that are provided in the head chip 11, thereby achieving high density.

For example, if the thickness of the piezoelectric layer 33 is reduced to make the piezoelectric actuator 30 thinner, electrostatic capacitance at the piezoelectric layer 33 will increase. For the purpose of ensuring a sufficient amount of deformative vibration of the diaphragm 26 by using such a thinner piezoelectric layer 33, an electric current supplied to the piezoelectric layer 33 tends to increase. Since the liquid ejecting head 10 offers improved heat release performance and makes it possible to suppress a rise in temperature of the drive circuit 42, it is possible to make the piezoelectric layer 33 thinner to make the piezoelectric actuator 30 thinner. This makes it possible to reduce the size of the head chip 11.

For example, if the number of times of ink ejection per unit time increases, the amount of heat produced from the drive circuit 42 tends to increase due to an increase in switching frequency and electric current at the drive circuit 42. Since the liquid ejecting head 10 offers improved heat release performance and makes it possible to suppress a rise in temperature of the drive circuit 42, it is possible to increase the speed of ink ejection from the head chip 11.

In the present embodiment, both the pressure chamber 57A and the pressure chamber 57B are provided for each one nozzle N. However, either the pressure chamber 57A or the pressure chamber 57B only, instead of both, may be provided.

Figure 12:
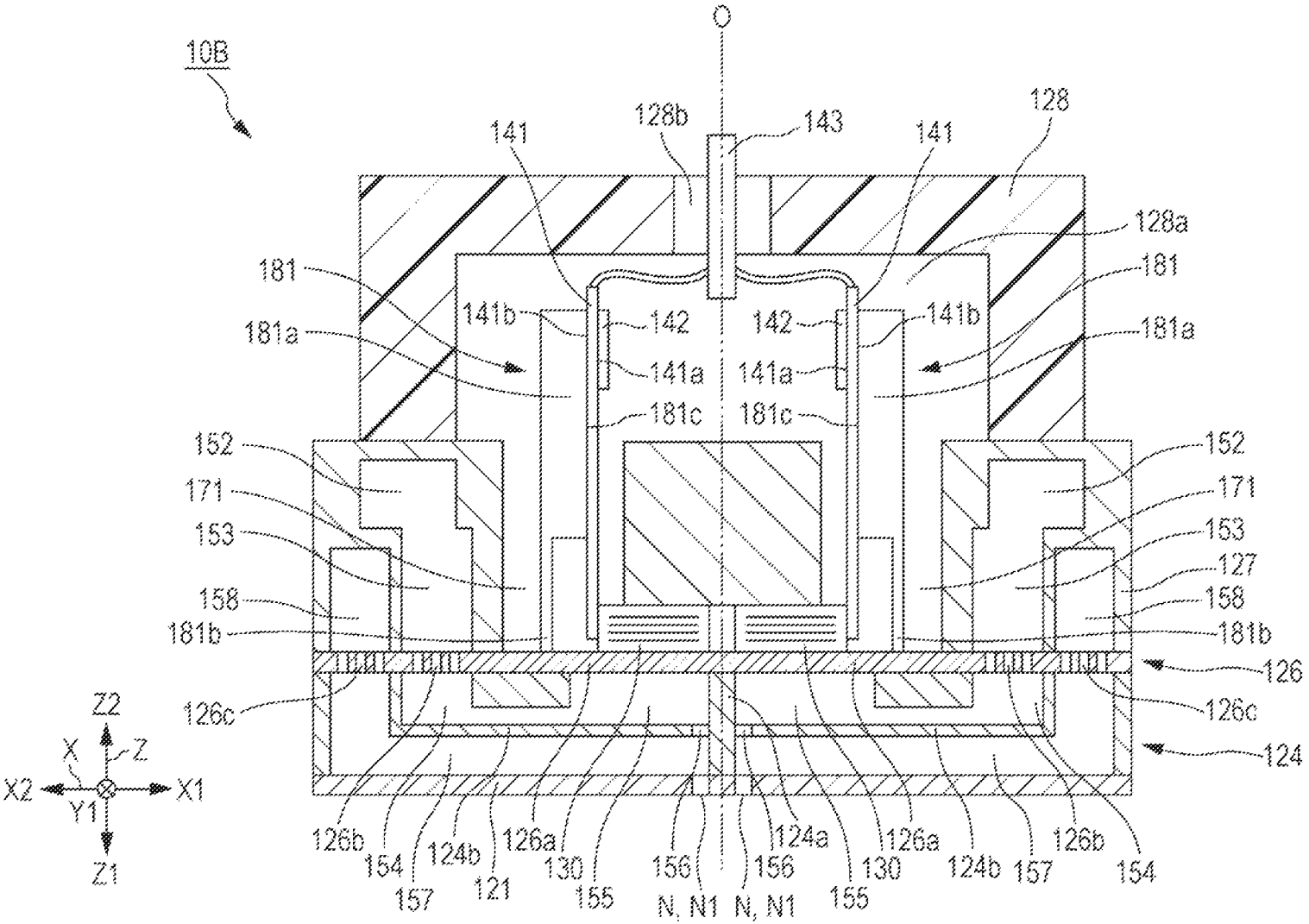
FIG. 12 is a cross-sectional view of a liquid ejecting head according to a second embodiment.

Next, with reference to FIG. 12, a liquid ejecting head 10B according to a second embodiment will now be explained. FIG. 12 is a cross-sectional view of a liquid ejecting head 10B according to a second embodiment. In the description of the second embodiment below, the same explanation as that of the first embodiment described above will not be given. The liquid ejecting head 10B includes a nozzle plate 121, a flow passage member 124, a diaphragm 126, a common chamber forming member 127, a case 128, piezoelectric actuators 130, an FPC (Flexible Printed Circuit) 141, a drive circuit 142, a circuit board 143, and a heat release member 181.

The liquid ejecting head 10B has a line-symmetric structure with respect to the center line O that goes through the X-directional center and extends in the Z-axis direction. In the liquid ejecting head 10B, the nozzle plate 121, the flow passage member 124, the diaphragm 126, and the common chamber forming member 127 are disposed in this order from the bottom. The common chamber forming member 127 may be, for example, made up of a plurality of members.

The nozzle plate 121 has a plurality of nozzles N. These nozzles N are arranged next to one another in the Y-axis direction to constitute a nozzle row N1. There are common chambers 152, 153, individual supply flow passages 154, pressure chambers 155, communication holes 156, individual collection flow passages 157, and common chambers 158 inside the liquid ejecting head 10B. Ink flows through a flow passage constituted of them inside the liquid ejecting head 10B.

The common chamber forming member 127 has the common chambers 152, 153, and 158. The common chamber forming member 127 is made of, for example, stainless steel. The common chamber forming member 127 may be made of any other kind of metal such as aluminum or copper. The common chamber forming member 127 may be made of resin.

The common chamber 152 is in communication with the common chamber 153 in the Z-axis direction. The common chambers 152 and 153 are included in a supply-side flow passage through which ink is supplied to the pressure chambers 155. The common chambers 158 are disposed outside the common chambers 153 in the X-axis direction. The word "outside" mentioned here means the side that is farther from the center line O. The word "inside" means the side that is closer to the center line O. The common chambers 158 are included in a collection-side flow passage through which, of ink forced out of the pressure chambers 155, ink that is not ejected from the nozzles N are collected. At the center region of the common chamber forming member 127 in the X-axis direction, there is a space in which the piezoelectric actuators 130, the FPC 141, and the heat release member 181 are disposed. A detailed explanation will be given later.

The diaphragm 126 includes a vibrating portion 126*a*, a filter portion 126*b*, and another filter portion 126*c*. The vibrating portion 126*a* constitutes the Z2-side wall surface of each pressure chamber 155. The filter portion 126*b* and the filter portion 126*c* are disposed outside the vibrating portion 126*a* in the X-axis direction.

The diaphragm 126 is made of, for example, nickel (Ni). The diaphragm 126 may be made of nickel alloy that contains nickel. The diaphragm 126 may be made of any other kind of metal. The thickness of the diaphragm 126 may be, for example, 40 μm or less. The diaphragm 126 may have a layered structure made up of a plurality of diaphragms stacked in the Z-axis direction. The total thickness of the diaphragm 126 may be 100 μm or less.

The filter portion 126*b* is disposed on the Z1-directional side with respect to the common chamber 153. The ink present in the common chamber 153 passes through the filter portion 126*b* to flow into each individual supply flow passage 154. The Z2-side surface of the filter portion 126*b* constitutes a part of the Z1-side wall surface of the common chamber 153. The Z1-side surface of the filter portion 126*b* constitutes a part of the Z2-side wall surface of each individual supply flow passage 154.

The filter portion 126*c* is disposed on the Z1-directional side with respect to the common chamber 158. The ink present in each individual collection flow passage 157 passes through the filter portion 126*c* to flow into the common chamber 158. The Z2-side surface of the filter portion 126*c* constitutes a part of the Z1-side wall surface of the common chamber 158. The Z1-side surface of the filter portion 126*c* constitutes a part of the Z2-side wall surface of each individual collection flow passage 157. The diaphragm 126 may include a portion that serves as a compliance substrate. With this structure, it is possible to transfer heat to ink from the portion that serves as a compliance substrate.

The flow passage member 124 has the individual supply flow passages 154, the pressure chambers 155, the communication holes 156, and the individual collection flow passages 157. The individual supply flow passage 154 is in communication with the common chamber 153 through the filter portion 126*b*. The individual supply flow passage 154 extends in the X-axis direction and is in communication with the pressure chamber 155.

The flow passage member 124 is made of, for example, stainless steel. The flow passage member 124 may be made of any other kind of metal such as, for example, aluminum or copper. The flow passage member 124 may be made of resin. A plurality of plate members may be stacked in the Z-axis direction to constitute the flow passage member 124.

There is a partition wall 124*a* at the center of the flow passage member 124 in the X-axis direction. The thickness direction of the partition wall 124*a* is along the X axis. The pressure chambers 155 are arranged on one side and the opposite side in the X-axis direction, with the partition wall 124*a* located therebetween. The partition wall 124*a* constitutes a part of the wall surface of the pressure chamber 155.

There is a partition wall 124*b* on the Z1-directional side with respect to the individual supply flow passage 154 and the pressure chamber 155. The thickness direction of the partition wall 124*b* is along the Z axis. The individual collection flow passage 157 is located on the Z1-directional side with respect to the partition wall 124*b*. The Z2-side surface of the partition wall 124*b* constitutes the Z1-side wall surface of the individual supply flow passage 154 and the Z1-side wall surface of the pressure chamber 155. The Z1-side surface of the partition wall 124*b* constitutes the Z2-side wall surface of the individual collection flow passage 157.

The communication hole 156 goes through the partition wall 124*b* in the Z-axis direction near the partition wall 124*a*. The communication hole 156 provides communication between the pressure chamber 155 and the individual collection flow passage 157. The ink present in the pressure chamber 155 flows through the communication hole 156 into the individual collection flow passage 157.

The individual collection flow passage 157 extends from the center region outward in the X-axis direction. The end, of the individual collection flow passage 157, that is farther from the center line O the X-axis direction goes in the Z2 direction for communication with the common chamber 158 through the filter portion 126*c*.

The nozzle N is located at a position near the partition wall 124*a* and on the Z1-directional side with respect to the communication hole 156. The ink that has passed through the communication hole 156 flows in the individual collection flow passage 157 in the Z1 direction for ejection from the nozzle N. The remaining part, of the ink, not ejected from the nozzle N flows through the individual collection flow passage 157, and then passes through the filter portion 126*c* to flow into the common chamber 158.

The piezoelectric actuators 130 are arranged at the center region of the common chamber forming member 127 in the X-axis direction. The piezoelectric actuators 130 are disposed on the Z2-directional side with respect to the pressure chambers 155. The diaphragm 126 is disposed between the piezoelectric actuators 130 and the pressure chambers 155. The common chamber forming member 127 has an opening 171 going therethrough in the Z-axis direction.

The opening 171 is located between the piezoelectric actuators 130 and the common chambers 152, 153, and 158 in the X-axis direction. The case 128 is made of, for example, resin. The case 128 has a cavity 128*a* that is formed in such a way as to be recessed in the Z2 direction from its Z1-side surface. The case 128 has, at its center in the X-axis direction, an opening 128*b* going therethrough in the Z-axis direction. The opening 171 of the common chamber forming member 127 is in communication with the cavity 128*a* of the case 128, and the cavity 128*a* of the case 128 is in communication with the opening 128*b* of the case 128.

The FPC 141 and the heat release member 181 extend in the Z-axis direction inside the opening 171 and the cavity 128*a*. The drive circuit 142 is disposed inside the cavity 128*a*. The Z1-side portion of the FPC 141 is inserted into the opening 171 and is electrically coupled to the piezoelectric actuators 130. The thickness direction of the FPC 141 is along the X axis. The length of the FPC 141 in the Y-axis direction corresponds to the length of the nozzle row N1 in the Y-axis direction.

The FPC 141 is electrically coupled to the circuit board 143. The circuit board 143 is disposed inside the opening 128*b* of the case 128. The thickness direction of the circuit board 143 is along the X axis. The Z1-side end portion of the circuit board 143 protrudes into the cavity 128*a*. The Z2-side end portion of the circuit board 143 protrudes to the outside of the case 128.

The drive circuit 142 is mounted on a surface 141*a* of the FPC 141. The surface 141*a* is, for example, the surface that is closer to the center line O. The heat release member 181 is provided on the opposite surface 141*b*, which is the opposite of the surface 141*a* of the FPC 141. The heat release member 181 has a plate-like shape. The thickness direction of the heat release member 181 is along the X axis.

The heat release member 181 is in contact with the surface 141*b* of the FPC 141. The heat release member 181 has a body portion 181*a* and an end portion 181*b*. The body portion 181*a* is in contact with the FPC 141. The end portion 181*b* extends from the body portion 181*a* in the Z1 direction. The surface 181*c* of the body portion 181*a* is in contact with the surface 141*b* of the FPC 141. The Z1-side end portion 181*b* is in contact with the diaphragm 126. The thickness of the end portion 181*b* is less than the thickness of the body portion 181*a*. There is a gap between the end portion 181*b* and the FPC 141 in in the X-axis direction, meaning that they are not in contact with each other. The individual supply flow passage 154 is located on the Z1-directional side with respect to the diaphragm 126. The position where the end portion 181*b* is in contact with the diaphragm 126 is closer to the individual supply flow passage 154 than the individual collection flow passage 157.

In the liquid ejecting head 10B described above, a drive signal is outputted from the drive circuit 142 to drive the piezoelectric actuator 130. The driving causes the vibrating portion 126*a* of the diaphragm 126 to vibrate, thereby forcing ink out of the pressure chamber 155 and ejecting the ink from the nozzle N.

The heat produced from the drive circuit 142 is transmitted via the FPC 141 to the body portion 181*a* of the heat release member 181. The heat conveyed by conduction by the body portion 181*a* is conducted from the end portion 181*b* to the diaphragm 126. The heat conducted to the diaphragm 26 is transferred to the ink present in the pressure chambers 155 via the vibrating portion 126*a* constituting a part of the wall surfaces of the pressure chambers 155.

A part of the heat conducted to the diaphragm 26 is transferred from the filter portion 126*b* to the ink passing through the filter portion 126*b*. A part of the heat conducted to the diaphragm 26 is transferred to the ink passing through the filter portion 126*c*.

A part of the heat conducted to the diaphragm 26 is conducted to the common chamber forming member 127 made of metal. Therefore, it is possible to transfer the heat to the ink present in the common chambers 152, 153, and 158 from the wall surfaces of the common chambers 152, 153, and 158.

A part of the heat conducted to the diaphragm 26 is conducted to the flow passage member 124 made of metal. The flow passage member 124 has the plurality of pressure chambers 155. The pressure chambers 155 are arranged at a predetermined pitch in the Y-axis direction. Partition walls are provided between the pressure chambers 155 arranged next to one another in the Y-axis direction. It is possible to transfer the heat to the ink present in the pressure chambers 155 from, for example, the partition walls arranged between the pressure chambers 155 in the Y-axis direction, too. In addition, it is possible to transfer the heat to the ink present in the flow passage member 124 via the partition wall 124*a* and the partition wall 124*b*, too.

The ink to which the heat has been transferred via the diaphragm 126 is either ejected from the nozzle N or flows through the individual collection flow passage 157 to be circulated. By this means, the heat is let out of the liquid ejecting head 10B. A part of the heat is dispersed inside the liquid ejecting head 10B. The dispersed heat can be dissipated from various parts of the liquid ejecting head 10B.

Similarly to the liquid ejecting head 10 according to the first embodiment described earlier, the liquid ejecting head 10B described above makes it possible to suppress a rise in temperature of the drive circuit 142. In addition, the liquid ejecting head 10B makes it possible to increase the area size of heat transfer from the diaphragm 126 to ink.

Figure 13:
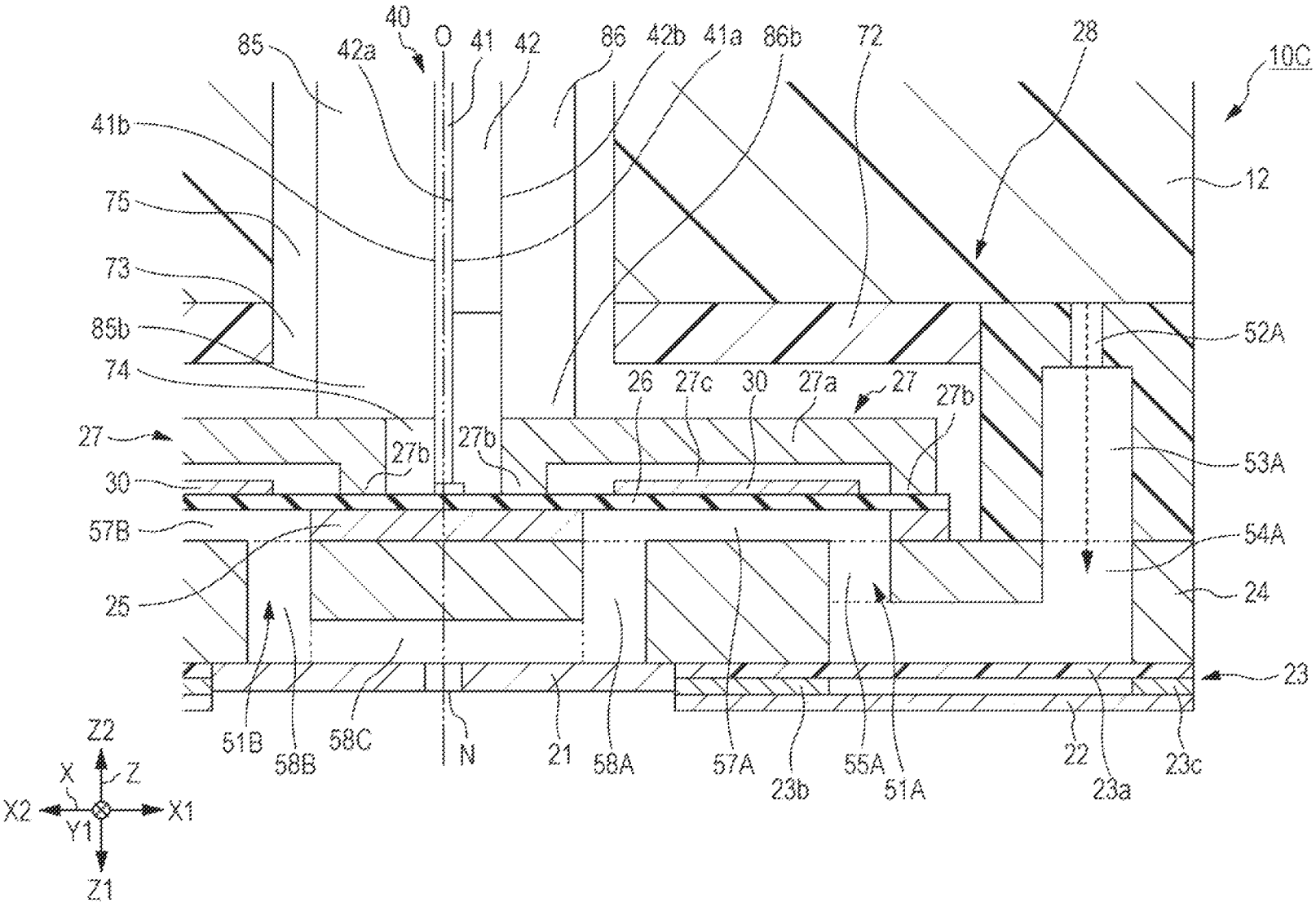
FIG. 13 is a cross-sectional view of a liquid ejecting head according to a modification example.

Next, with reference to FIG. 13, a liquid ejecting head 10C according to a modification example will now be explained. FIG. 13 is a cross-sectional view of a liquid ejecting head 10C according to a modification example. The liquid ejecting head 10C illustrated in FIG. 13 is different from the liquid ejecting head 10 according to the first embodiment in that, firstly, a heat release member 85 is connected to a portion, of the protective substrate 27, closer to the collection-side pressure chambers 57B, and, secondly, a heat release member 86 that is directly in contact with the drive circuit 42 is provided. In the description of the present modification example below, the same explanation as that of the liquid ejecting head 10 according to the first embodiment will not be given.

The drive circuit 42 is provided on the surface 41*a* of the flexible wiring board 41. The surface 41*a* is, for example, the X1-side surface of the flexible wiring board 41. The heat release member 85 is provided on the surface 41*b* of the flexible wiring board 41. The surface 41*b* is the opposite surface, which is the opposite of the surface 41*a* on which the drive circuit 42 is provided. The Z1-side end 85*b* of the heat release member 85 is in contact with a portion, of the protective substrate 27, closer to the correction-side pressure chambers 57B. As described here, the heat release member 85 may be connected to the protective substrate at a position closer to the correction-side pressure chambers 57B.

The heat release member 86 is directly in contact with the drive circuit 42. The direct contact of the heat release member 86 with the drive circuit 42 means that the flexible wiring board 41 is not disposed between the heat release member 86 and the drive circuit 42. The surface 42*a* of the drive circuit 42 is its X2-side surface that is in contact with the flexible wiring board 41. The surface 42*b* of the drive circuit 42 is its X1-side surface that is the opposite of the surface 42*a*. The heat release member 86 is disposed on the X1-directional side with respect to the drive circuit 42 and is in contact with the surface 42*b* of the drive circuit 42. The Z1-side end 86*b* of the heat release member 86 is in contact with a portion, of the protective substrate 27, closer to the supply-side pressure chambers 57A. As described here, the heat release member 86 may be in contact with the surface 42*b* of the drive circuit 42.

The liquid ejecting head 10C according to the modification example described above produces the same operational effects as those of the liquid ejecting head 10 described earlier. In the liquid ejecting head 10C, the heat release member 85 is disposed on one side with respect to the drive circuit 42 in the X-axis direction, and the heat release member 86 is disposed on the opposite side with respect to the drive circuit 42 in the X-axis direction. Because of this structure, it is possible to release the heat of the drive circuit 42 efficiently.

The foregoing embodiments merely disclose typical examples of the present disclosure. The scope of the present disclosure is not limited to the foregoing embodiments. Various modifications and additions, etc. can be made within a range not departing from the gist of the present disclosure.

In the foregoing embodiments, the line-type liquid ejecting apparatus 1 equipped with the line head 6 has been described to show some examples. However, the present disclosure may be applied to a so-called serial-type liquid ejecting apparatus configured to reciprocate, in the width direction of the medium PA, a carriage on which the liquid ejecting heads 10 are mounted.

In the foregoing embodiments, the liquid ejecting head 10 includes the case 28 and the holder 12 as an example of a flow passage member that has a flow passage through which ink flows. However, the scope of the present disclosure is not limited to this example. The liquid ejecting head 10 may include the holder 12 only as an example of the flow passage member, without being equipped with the case 28. The liquid ejecting head 10 may include the case 28 only as an example of the flow passage member, without being equipped with the holder 12.

The liquid ejecting apparatus 1 disclosed as examples in the foregoing embodiments can be applied to not only print-only machines but also various kinds of equipment such as facsimiles and copiers, etc. The scope of application of a liquid ejecting apparatus according to the present disclosure is not limited to printing. For example, a liquid ejecting apparatus that ejects a colorant solution can be used as an apparatus for manufacturing a color filter of a display device such as a liquid crystal display panel. A liquid ejecting apparatus that ejects a solution of a conductive material can be used as a manufacturing apparatus for forming wiring lines and electrodes of a wiring substrate. A liquid ejecting apparatus that ejects a solution of a living organic material can be used as a manufacturing apparatus for, for example, production of biochips.

What is claimed is:

1. A liquid ejecting head, comprising:

piezoelectric elements driving to eject liquid from nozzles in an ejecting direction;

pressure chambers in communication with the nozzles respectively;

individual supply flow passages for supplying the liquid to each of the nozzles;

individual collection for collecting the liquid not ejected from each of the nozzles;

a diaphragm that deforms by driving the piezoelectric element;

a flexible substrate having a drive circuit electrically coupled to the piezoelectric elements; and a heat release member that is either in contact with a surface of the flexible substrate that faces away from the drive circuit, or in contact with the drive circuit; wherein the diaphragm includes a first surface that defines a wall surface of the pressure chambers, and a second surface that is opposite from the first surface, the heat release member is configured to conduct heat of the drive circuit toward the second surface of the diaphragm, and the heat release member is disposed closer to the individual supply flow passage than to the individual collection flow passage.

2. The liquid ejecting head according to claim 1, further comprising:

a flow passage member that has an opening and a common flow passage and that is made of resin, the flexible substrate being inserted in the opening, the common flow passage being in communication with the pressure chambers; and a circuit board that is stacked on or over the flow passage member and is electrically coupled to the flexible substrate; wherein the drive circuit is disposed inside the opening of the flow passage member.

3. The liquid ejecting head according to claim 1, further comprising:

a protective substrate that has a concave portion recessed in a direction that is opposite of the ejecting direction in such a way as to enclose the piezoelectric elements as viewed in the ejecting direction, and seals the piezoelectric elements between the protective substrate itself and the diaphragm by being stacked on the diaphragm; wherein the protective substrate is made of metal, or ceramic, and the heat release member is in contact with the protective substrate.

4. The liquid ejecting head according to claim 3, wherein the protective substrate does not define flow passage through which the liquid flows.

5. The liquid ejecting head according to claim 3, wherein a portion, of the heat release member, that is in contact with the protective substrate is located closer to the individual supply flow passage than to the individual collection flow passage.

6. The liquid ejecting head according to claim 3, wherein the nozzles are arranged in a first direction to constitute a nozzle row, the protective substrate includes an opening in which the flexible substrate is inserted, and a width in a second direction, which is orthogonal to the first direction and the ejecting direction, of the heat release member at an end portion closer to the diaphragm is greater than a width in the second direction of the opening of the protective substrate.

7. The liquid ejecting head according to claim 1, wherein the heat release member is directly connected to the diaphragm, and the diaphragm is made of metal.

8. The liquid ejecting head according to claim 7, wherein a part of the diaphragm includes a filter portion through which the liquid passes at a position different from the wall surface of the pressure chamber.

9. The liquid ejecting head according to claim 7, wherein a portion, of the heat release member, that is in contact with the diaphragm is located closer to the individual supply flow passage than to the individual collection flow passage.

10. The liquid ejecting head according to claim 1, wherein the heat release member is made of metal.

11. The liquid ejecting head according to claim 1, wherein the heat release member is made of ceramic.

12. A liquid ejecting apparatus, comprising:

the liquid ejecting head according to claim 1; and a liquid containing unit that contains liquid that is to be supplied to the liquid ejecting head.

* * * * *